US007792674B2

(12) United States Patent
Dalton, Jr. et al.

(10) Patent No.: US 7,792,674 B2
(45) Date of Patent: Sep. 7, 2010

(54) SYSTEM AND METHOD FOR PROVIDING VIRTUAL SPATIAL SOUND WITH AN AUDIO VISUAL PLAYER

(75) Inventors: Robert J. E. Dalton, Jr., San Francisco, CA (US); Rupen Dolasia, Mill Valley, CA (US)

(73) Assignee: Smith Micro Software, Inc., Aliso Viejo, CA (US)

( * ) Notice: Subject to any disclaimer, the term of this patent is extended or adjusted under 35 U.S.C. 154(b) by 830 days.

(21) Appl. No.: 11/731,682

(22) Filed: Mar. 30, 2007

(65) Prior Publication Data

US 2008/0243278 A1 Oct. 2, 2008

(51) Int. Cl.
*G10L 21/00* (2006.01)

(52) U.S. Cl. ..... 704/270; 704/278; 704/200; 381/17; 381/119; 381/1

(58) Field of Classification Search ..... 704/278, 704/270, 200, 205, 206, 207, 220, 270.1; 381/1, 17, 119
See application file for complete search history.

(56) References Cited

U.S. PATENT DOCUMENTS 5,796,843 A * 8/1998 Inanaga et al. ..... 381/17
2004/0076301 A1 4/2004 Algazi et al.
2007/0009120 A1 1/2007 Algazi et al.

OTHER PUBLICATIONS

Algazi et al., "Motion-Tracked Binaural Sound", J. Audio Eng. Soc. , vol. 52, No. 11, Nov. 2004, pp. 1142-1156.
Brown et al., "A Structural Model for Binaural Sound Synthesis", IEEE Transactions on Speech and Audio Processing, vol. 6, No. 5, Sep. 1998, pp. 476-488.
Algazi et al., "Structural Composition and Decomposition of HRTFS", IEEE Workshop on Applications of Signal Processing to Audio and Acoustics, Oct. 21-24, 2001, New Paltz, New York, pp. 103-106.
Duda R., "3-D Audio for HCI", http://interface.cipic.ucdavis.edu/CIL_tutorial/3D_home.htm, Jun. 26, 2000, 2 Pages.
"MTB-Motion Tracked Binaural Sound", http:// interface,cipic.ucdavis.edu/CIL_html/CIL_MTB.htm printed Jun. 20, 2007, pp. 1-9.
Muzychenko, "Eugene Muzychenko Software Page.", http://software.muzychenko.net.eng printed Jun. 20, 2007, pp. 1-2.
"A Schroeder Reverberator called JCRev", http://ccrma.stanford.edu/~jos/pasp/Schroeder_Reverberator_called_JCRev.html printed Jun. 20, 2007, pp. 1-3.
Begault D., "3-D Sound for Virtual Reality and Multimedia", AP Professional, Boston, MA, 1994, 8 Pages.

* cited by examiner

*Primary Examiner*—Huyen X. Vo
(74) *Attorney, Agent, or Firm*—Blakely, Sokoloff, Taylor & Zafman LLP

(57) ABSTRACT

A method and machine-readable medium for providing virtual spatial sound with an audio visual player are disclosed. Input audio is processed into output audio having spatial attributes associated with the spatial sound represented in a room display.

46 Claims, 14 Drawing Sheets

SYSTEM AND METHOD FOR PROVIDING VIRTUAL SPATIAL SOUND WITH AN AUDIO VISUAL PLAYER

FIELD OF THE INVENTION

The invention relates generally to the field of data processing. More specifically, the invention relates to a system and method for providing virtual spatial sound.

BACKGROUND

The basic idea behind spatial sound is to process a sound source so that it will contain the necessary spatial attributes of a source located at a particular point in a 3D space. The listener will then perceive the sound as if it were coming from the intended location. The resulting audio is commonly referred to as virtual sound since the spatially positioned sounds are synthetically produced. Virtual spatial sound has long been an active research topic and has recently increased in popularity because of the increase in raw digital processing power. It is now possible to perform the required real-time processing on a commercial computer that once took special dedicated hardware.

When locating sound sources, listeners unknowingly determine the azimuth, elevation, and range of the source.

To determine the source azimuth (the angle between the listener's forward facing direction and the sound source) two primary cues are used, the interaural time difference (ITD) and the interaural level difference (ILD). Simply put, this means that sources outside the median plane (not directly in front of the listener) will arrive at one ear before the other (ITD) and the sound pressure level at one ear will be greater than the other (ILD). FIG. 1*a* shows an image of a sound source 100 as it propagates towards the listener's ears 102, 103. This figure shows the extra distance the sound must travel to reach the left ear (contralateral ear) 102 (hence, the left ear has a longer arrival time). Additionally, the head will naturally reflect and absorb more of the sound wave before it reaches the left ear 102. This is referred to as a head shadow and the result is a diminished sound pressure level at the left ear 102.

The listener's pinna (outer ear) is the primary mechanism for providing elevation cues for a source, as shown in FIGS. 1*b* & 1*c*. To determine range, the loudness of the source 100 and the ratio of direct to reverberant energy are used. There are a number of other factors that can be considered, but these are the primary cues that one attempts to reproduce to accurately represent a source at a particular location in space.

Reproducing spatial sound can be done either using loudspeakers or headphones; however headphones are commonly used since they are easily controlled. A major obstacle of loudspeaker reproduction is the cross-talk that occurs between the left and right loudspeakers. Furthermore, headphone-based reproduction eliminates the need for a sweet-spot. The virtual sound synthesis techniques discussed assume headphone-based reproduction.

The most common approach for rendering virtual spatial sound is through the use of Head Related Impulse Responses (HRIRs) or their frequency domain equivalent Head Related Transfer Functions (HRTFs). These transfer functions completely characterize the changes a sound wave undergoes as it travels from the sound source to the listener's inner ear. HRTFs vary with source azimuth, elevation, range and frequency, so a complete collection of measurements are needed if a source is to be placed anywhere in a 3D space.

If the source or listener were to move so that the source position relative to the listener changes, the HRTFs need to be updated to reflect the new source position. In this implementation, a pair of left/right HRTFs are selected from a lookup table based on listener's head position/rotation and the source position. The left and right ear signals are then synthesized by filtering the audio data with these HRTF (or in the time domain by convolving the audio data with the HRIRs).

HRTFs can synthesize very realistic spatial sound. Unfortunately, since HRTFs capture the effects of the listener's head, pinna (outer ear), and possibly the torso, the resulting functions are very listener dependent. If the HRTF doesn't match the anthropometry of the listener, then it can fail to produce the virtual sounds accurately. A generalized HRTF that can be tuned for any listener continues to be an active research topic.

Another drawback of HRTF synthesis is the amount of computation required. HRTFs are rather short filters and therefore do not capture the acoustics of a room. Introducing room reflections drastically increase the computation since each reflection should be spatialized by filtering the reflection with a pair of the appropriate HRTFs.

A less individualized, but more computationally efficient implementation uses a model-based HRTF. A model strives to capture the primary localization cues as accurately as possible regardless of the listener's anthropometry. Typically, a model can be tuned to the listener's liking. One such model is the spherical head model. This model replaces the listener's head with a sphere that closely matches the listener's head diameter (where the diameter can be changed). The model produces accurate ILD changes caused by head-shadowing. The ITD can then be found from the source to listener geometry. While not the ideal case, such models can offer a close approximation. However, models are typically more computationally efficient. One major drawback is that since the spherical head model does not include pinnae (outer ears), the elevation cues are not preserved.

A recent alternative technique is Motion-Tracked Binaural (MTB) sound. As its name suggests, MTB is a generalization of binaural recordings, which offer the most realistic spatial sound reproductions as they capture all of the static localization cues including the room acoustics. This technology was developed at the Center for Image Processing and Integrated Computing (CIPIC) at U.C. Davis. The difference between MTB and other binaural recordings is that MTB captures the entire sound field (in the horizontal plane, 0 degrees elevation), thus preserving the dynamic localization cues. Unlike binaural recording which rotate with the listener head rotation, MTB stabilizes the reproduced sound field as the listener turns his head.

The MTB synthesis technique operates off of a total of either 8 or 16 audio channels (for full 360 degree sound reproduction). The channels can either be recorded live using and MTB microphone array, or they can be virtually produced using the measured response, Room Impulse Responses (RIRs), of the MTB microphone array. The conversion of a stereo audio track to the MTB signals can be done in non-realtime leaving only a small interpolation operation to be performed in real-time between the nearest and next-nearest microphone for each of the listeners ears, as shown in FIG. 1*d*.

FIG. 1*d* shows an image of an 8-channel MTB microphone array shown as audio channels 104-111. From this figure it can be seen that the signals for the listener's left and right ears 112,113 are synthesized from the audio channels that surround the ears (the nearest and next-nearest audio channels). For the listener's head position shown, the left ear's nearest audio channel and next nearest audio channel are audio channels 104 and 105, respectively. The right ear's nearest and next nearest audio channels are audio channels 108 and 109, respectively. This technique requires very little real-time processing at the expense of slightly more storage for the additional audio channels.

What is needed is a system and method for presenting virtual spatial sound that captures realistic spatial acoustic attributes of a sound source that is computationally efficient. An audio visual player is needed that will provide for changes in spatial attributes in real time.

Many audio players today allow a user to have a library of audio files stored in memory. Furthermore, these audio files may be organized into playlists which include a list of specific audio files. For example, a playlist entitled "Classical Music" may be created which includes all of a user's classical music audio files. What is needed is a playlist that will take into account spatial attributes of audio files. Furthermore, what is needed is a way to share the playlists.

Some audio players exist that allow audio streams from remote sites to be played. Furthermore, search engines exist that allow for searching of audio and video streams available on the internet. However, opening several application windows for web browsing, identifying audio/video streams, and audio playing can be inconvenient. What is needed is an audiovisual player that provides for these multitude of tasks in a single application window. Still further, what is needed is an audiovisual player that also provides spatial sound in addition to these multitude of tasks.

SUMMARY OF THE INVENTION

In one embodiment, a method is disclosed that may include: generating a room display including a background image, a listener image, and at least one source image, wherein the listener image and at least one source image are displayed in an initial orientation, the initial orientation having initial spatial attributes associated with it; receiving an indication of a first audio file to be played with the initial spatial attributes; receiving input audio for the first audio file; and processing the input audio into output audio having the initial spatial attributes; wherein processing of the input audio includes a processing task for sampling the orientations of the listener image and the at least one source image, the sampling used to determine a source azimuth and first order reflections for each of the at least one source image within the room display.

In another embodiment, a method is disclosed that may include: receiving an indication that a first virtualprogram is selected to be loaded and played, the first virtualprogram having an first associated audio file saved within it; loading and playing the first virtualprogram, wherein the loading and playing of the virtual program includes generating a room display including a background image, a listener image, and at least one source image, wherein the orientation of the listener image and at least one source image have spatial attributes associated with it and are configured according to the first virtualprogram; receiving input audio for the first associated audio file; and processing the input audio for the first associated audio file into output audio having spatial attributes for the first virtualprogram.

In yet another embodiment, a machine-readable medium is disclosed that provides instructions, which when executed by a machine, cause the machine to perform operations that may include: generating a room display including a background image, a listener image, and at least one source image, wherein the listener image and at least one source image are displayed in an initial orientation, the initial orientation having initial spatial attributes associated with it; receiving an indication of a first audio file to be played with the initial spatial attributes; receiving input audio for the first audio file; and processing the input audio into output audio having the initial spatial attributes; wherein processing of the input audio includes a processing task for sampling the orientations of the listener image and the at least one source image, the sampling used to determine a source azimuth and first order reflections for each of the at least one source image within the room display.

In yet another embodiment, a machine-readable medium is disclosed that provides instructions, which when executed by a machine, cause the machine to perform operations that may include: receiving an indication that a first virtualprogram is selected to be loaded and played, the first virtualprogram having an first associated audio file saved within it; loading and playing the first virtualprogram, wherein the loading and playing of the virtual program includes generating a room display including a background image, a listener image, and at least one source image, wherein the orientation of the listener image and at least one source image have spatial attributes associated with it and are configured according to the first virtualprogram; receiving input audio for the first associated audio file; and processing the input audio for the first associated audio file into output audio having spatial attributes for the first virtualprogram.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

In the following description, numerous specific details are set forth in order to provide a thorough understanding of the present invention. It will be apparent, however, to one skilled in the art that these specific details need not be employed to practice the present invention. In other instances, well known materials or methods have not been described in detail in order to avoid unnecessarily obscuring the present invention.

Note that in this description, references to "one embodiment" or "an embodiment" mean that the feature being referred to is included in at least one embodiment of the invention. Moreover, separate references to "one embodiment" in this description do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

Representing 3D Space & Spatial Attributes

Figure 6:
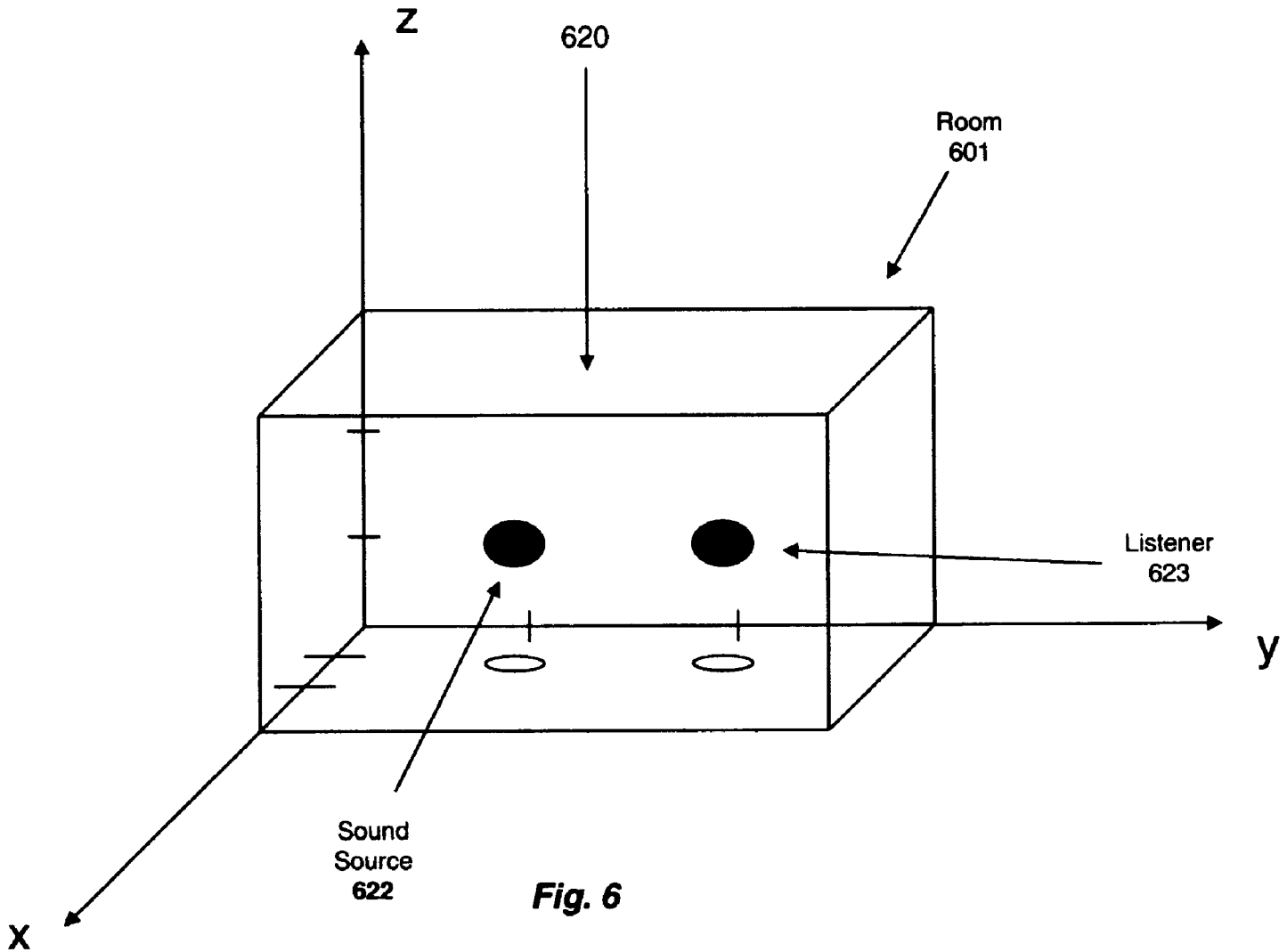
FIG. 6 illustrates a listener and sound source within a room along a three dimensional coordinate system, according to one embodiment of the invention.

Looking ahead to FIG. 6, a room 621 along a three dimensional coordinates system is illustrated. Within room 621 is a sound source 622 and a listener 623. The spatial sound heard by the listener 623 has spatial attributes associated with it (e.g., source azimuth, range, elevation, reflections, reverberation, room size, wall density, etc.). Audio processed to reflect these spatial attributes will yield virtual spatial sound.

Most of these spatial attributes depend on the orientation of the sound source 622 (i.e., its xyz-position) and the orientation of the listener 623 (i.e., his xyz-position as well as his forward facing direction) within the room 621. For example, if the sound source 622 is located at coordinates (1,1,1), and the listener 623 is located at coordinates (1,2,1) and facing the sound source, the spatial attributes will be different than if the listener 623 were in the corner of the room at coordinates of (0,0,0) facing in the positive x-direction (source 622 located to the right of his forward facing position). The system and method for simulating and presenting spatial sound to a user listening to audio from speakers (including speakers from headphones) are described.

Figures 1A, 1B, 1C, 1D:
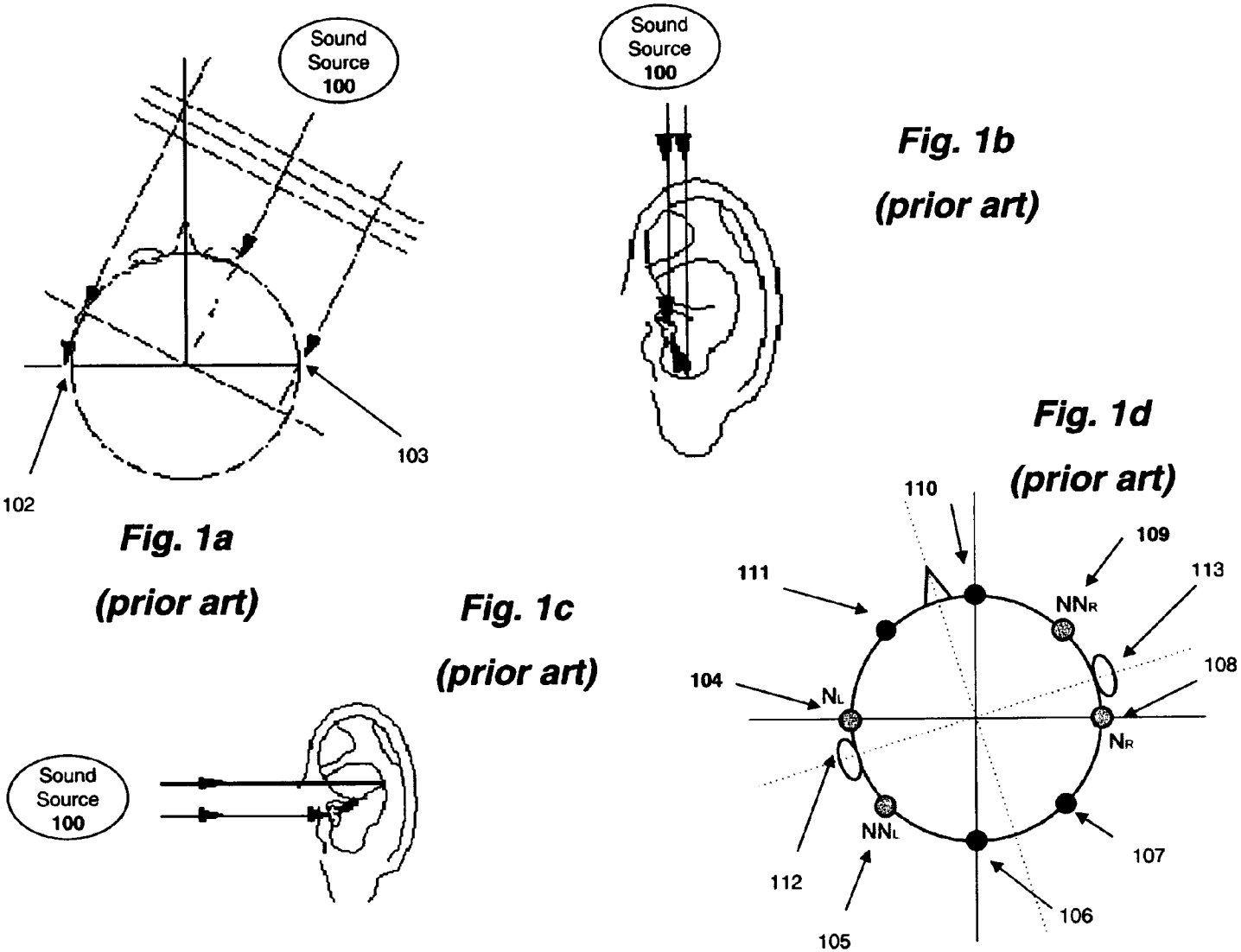
Fig. 1a (prior art)
Fig. 1b (prior art)
Fig. 1c (prior art)
Fig. 1d (prior art)
FIG. 1*a* (prior art) illustrates an image of a sound source 100 as it propagates towards the listener's ears 102,103.
FIGS. 1*b* & 1*c* (prior art) illustrates a listener's pinna (outer ear) as the primary mechanism for determining a source's elevation.
FIG. 1*d* (prior art) illustrates an image of an 8-channel MTB microphone array.
Figure 2:
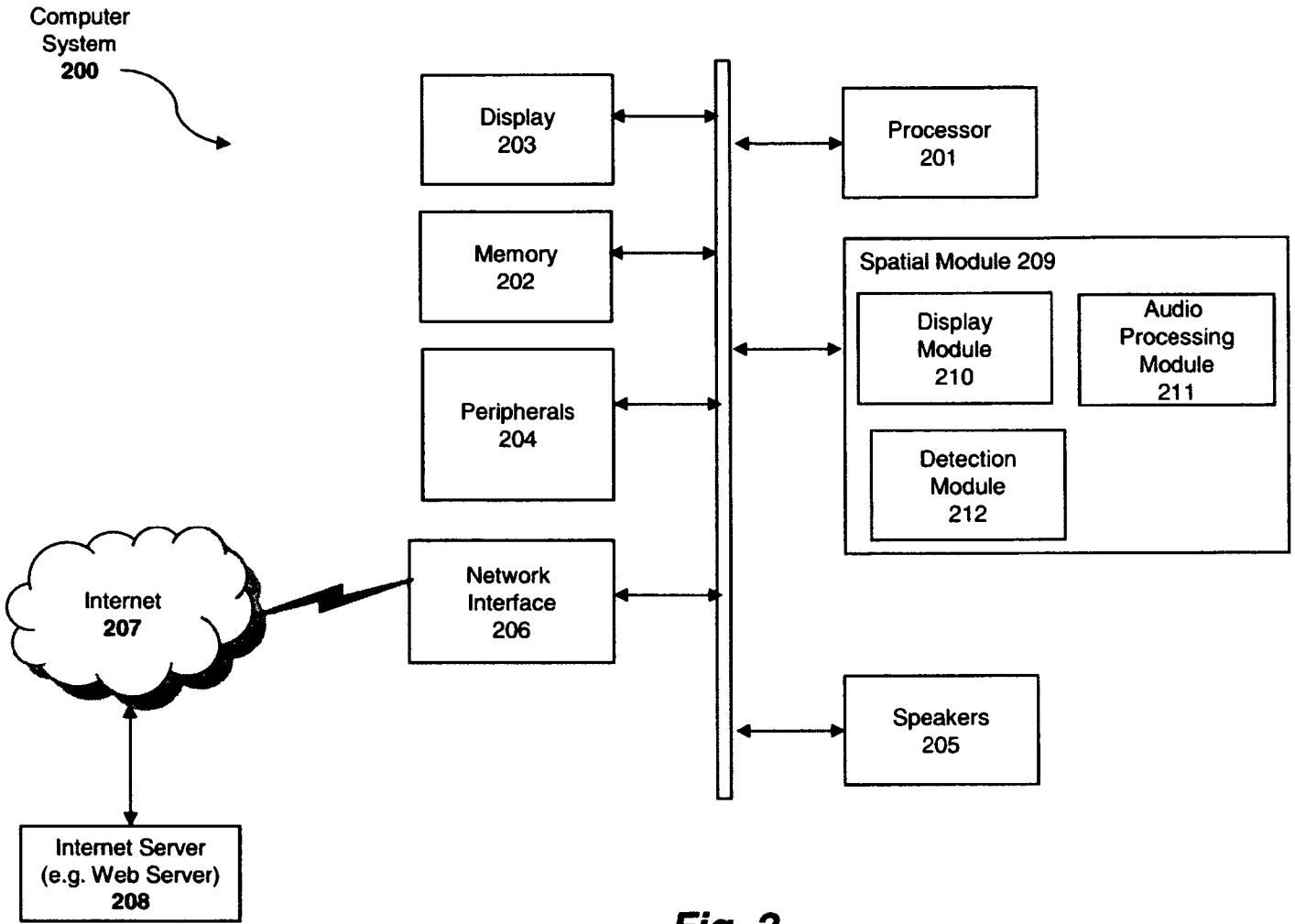
FIG. 2 illustrates a high level system diagram of a computer system implementing a spatial module, according to one embodiment of the invention.

FIG. 2 illustrates a high level system diagram of a computer system implementing spatial module 209, according to one embodiment of the invention. Computer system 200 includes a processor 201, memory 202, display 203, peripherals 204, speakers 205, and network interface 206 which are all communicably coupled to spatial module 209. Network interface 206 communicates with an internet server 208 through the internet 207. Network interface 206 may also communicate with other devices via the internet or intranet.

Spatial module 209 includes display generation module 210, audio processing module 211, and detection module 212. Display module 210 generates graphical user interface data to be displayed on display 203. Detection module 212 detects and monitors user input from peripherals 204, which may be, for example, a mouse, keyboard, headtracking device, wiimote, etc. Audio processing module 211 receives input audio and performs various processing tasks on it to produce output audio with spatial attributes associated with it. The audio input may, for example, originate from a file stored in memory, from an internet server 208 via the internet 207, or from any other audio source providing input audio (e.g., a virtual audio cable, which is discussed in further detail below). When the output audio is played over speakers (or headphones) and heard by a user, the virtual spatial sound the user hears will simulate the spatial sound from a sound source 622 as heard by a listener 623 in the room 621.

It should be appreciated that individual modules may be combined without compromising functionality. Thus, the underlying principles of the invention are not limited to the specific modules shown.

FIGS. 3*a*-3*f* illustrates a two dimensional graphical user interface generated by display module that can be used to represent the three dimensional virtual space described in FIG. 6, according to one embodiment of the invention. As shown in FIGS. 3*a*-3*f*, room display 300 presents a two dimensional viewpoint of the virtual space shown in FIG. 6 looking orthogonally into one of the sides of the room 121 (e.g., from the viewpoint of vector 620 shown in FIG. 6 pointing in the negative z-direction). Walls 310,320,330,340 represent side walls of room 621 and the other two walls (upper and lower) are not visible because the viewpoint is orthogonal to the plane of the two walls. Included within room display 300 is a first source image 301, a second source image 302, and a listener image 303. The first and second source images 301,302 represent a first and second sound source, respectively, within room 621. Any number of source images may be used to represent different numbers of sound sources. Likewise, listener image 303 represents a listener within room 621. In one embodiment, the first source image 301, a second source image 302, and a listener image 303 are at the same elevation and are fixed at that elevation. For example, the sound image 301,302 and listener image 303 may be fixed at an elevation that is in the middle of the height of the room. In another embodiment, the first sound image 301, a second sound image 302, and a listener image 303 are not at fixed elevations and may be represented at higher elevations by increasing the size of the image, or at lower elevations by decreasing the size of the image. A more in depth discussion of the audio processing than discussed for FIGS. 3*a*-3*f* will be described later.

Figure 3A:
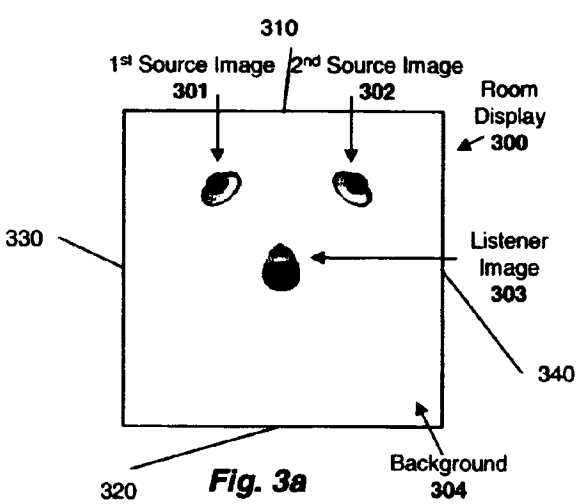
FIGS. 3*a*-3*f* illustrates a two dimensional graphical user interface generated by display module that can be used to represent the three dimensional virtual space, according to one embodiment of the invention.

In FIG. 3*a*, the listener image is oriented in the middle of the room display 300 facing the direction of wall 310. The first source image 301 is located in front of and to the left of the listener image. The second source image 302 is located in front of and to the right of the listener image. This particular orientation of the first source image 301, a second source image 302, and a listener image 303 yields spatial sound with specific spatial attributes associated with it. Therefore, when a user listens to the output audio with the spatial attributes associated with it, the virtual spatial sound the user hears will simulate the spatial sound from sound sources as heard by a listener 623 in the room 621. Not only will the user experience the sound as if it were coming from a first sound source to the front and left and a second sound source to the front and right, but the virtual spatial sound heard by the user will simulate all the spatial attributes that were taken into account during processing, such as range, azimuth (ILD and ITD), elevation, reflections, reverberation, room size, wall density, etc.

Figure 3B:
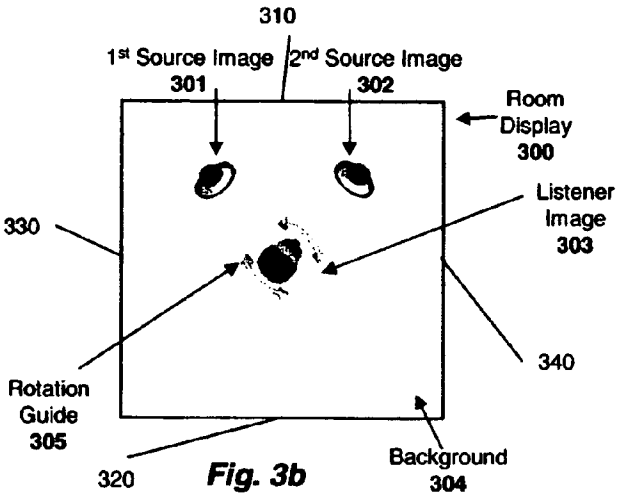

FIG. 3*b* illustrates a rotation of the listener image 303 within the room display 300. For example, a user may use a cursor control device to rotate the listener image (e.g., a mouse, keyboard, headtracking device, wiimote, etc., or any other human interface device. A rotation guide 305 may be generated to assist the user by indicating that the listener image is ready to be rotated or is currently being rotated. As shown in FIG. 3*b*, the listener image 303 is rotated clockwise from its position in FIG. 3*a* (facing directly into wall 310) to its position in 3*b* (facing the second source image 302). In the new position in FIG. 3*b*, the first source image 301 is now directly to the left of the listener image 303, and the second source image 302 is now directly in front of the listener image 303. Therefore, when the user listens to the output audio having spatial attributes associated with the new orientation, not only will the user experience the sound as if it were coming from a first sound source directly to the left and a second sound source directly in front, but the virtual spatial sound heard by the user will simulate all the spatial attributes that were taken into account during processing, such as range, azimuth (ILD and ITD), elevation, reflections, reverberation, room size, wall density, etc.

Furthermore, the rotational changes in orientation by the listener image 303 are sampled and processed at discrete intervals so to continually generate new output audio having spatial attributes for each new sampled orientation of the listener image during the rotation of the listener image 303. Therefore, when a user listens to the output audio during the rotation of listener image 303, the virtual spatial sound the user hears will simulate the change in spatial sound from the rotation of the listener image 303. Not only will the user experience the sound as if he had rotated from position one (where a first sound source is to the front and left and a second sound source to the front and right) to position two (where the first sound source is directly to the left and the second sound source is directly in front), but the virtual spatial sound heard during the rotation will simulate all the spatial attributes that were taken into account during processing, such as range, azimuth (ILD and ITD), elevation, reflections, reverberation, room size, wall density, etc.

Figure 3C:
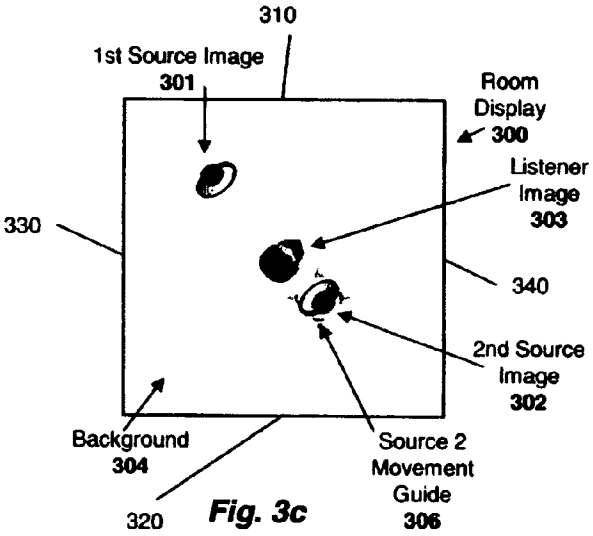

FIG. 3*c* illustrates a movement of the second source image 302 from its orientation in FIG. 3*b* to that shown in FIG. 3*c*. For example, a user may use a cursor control device to move the second source image 302. A second source movement guide 306 may be generated to assist the user by indicating that the second source image 302 is ready to be moved or is currently being moved. In the new position in FIG. 3*c*, the first source image 301 is now directly to the left of the listener image 303, and the second source image 302 is now directly to the right of the listener image 303 and very close in proximity to the listener image 303. Therefore, when the user listens to the output audio having spatial attributes associated with the new orientation, not only will the user experience the sound as if it were coming from a first sound source directly to the left and a second sound source directly to the right and very close in proximity, but the virtual spatial sound heard by the user will simulate all the spatial attributes that were taken into account during processing, such as range, azimuth (ILD and ITD), elevation, reflections, reverberation, room size, wall density, etc.

Furthermore, the changes in positional movement of the second source image 302 are sampled and processed at discrete intervals so to continually generate new output audio having spatial attributes for each new sampled orientation of the second source image 302 during the positional movement of the second source image 302. Therefore, when a user listens to the output audio during the positional movement of the second source image 302, the virtual spatial sound the user hears will simulate the change in spatial sound from the positional movement of the second source image 302. Not only will the user experience the sound as if the second sound source moved from position one (where the first sound source is directly to the left and the second sound source is directly in front) to position two (where the first sound source is directly to the left and the second sound source is directly to the right and close in proximity), but the virtual spatial sound heard during the positional movement will simulate all the spatial attributes that were taken into account during processing, such as range, azimuth (ILD and ITD), elevation, reflections, reverberation, room size, wall density, etc.

Figure 3D:
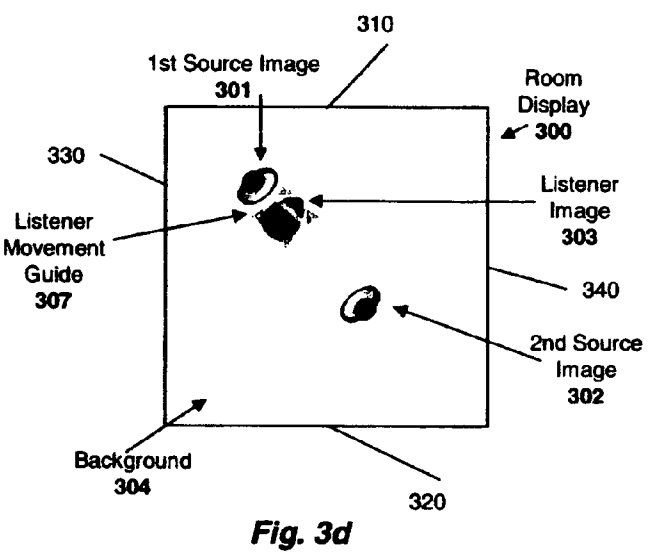

FIG. 3*d* illustrates a movement of the listener image 303 from its orientation in FIG. 3*c* to that shown in FIG. 3*d*. For example, a user may use a cursor control device to move the listener image 303. A listener movement guide 307 may be generated to assist the user by indicating that the listener image is ready to be moved or is currently being moved. In the new position in FIG. 3*c*, the first source image 301 is still directly to the left of the listener image 303 but now close in proximity, and the second source image 302 is still directly to the right of the listener image 303 but farther in proximity to the listener image 303. Therefore, when the user listens to the output audio having spatial attributes associated with the new orientation, not only will the user experience the sound as if it were coming from a first sound source directly to the left in very close proximity and a second sound source directly to the right in farther proximity, but the virtual spatial sound heard by the user will simulate all the spatial attributes that were taken into account during processing, such as range, azimuth (ILD and ITD), elevation, reflections, reverberation, room size, wall density, etc.

Furthermore, the changes in positional movement of the listener image 303 are sampled and processed at discrete intervals so to continually generate new output audio having spatial attributes for each new sampled orientation of the listener image during the positional movement of the listener image 303. Therefore, when a user listens to the output audio during the positional movement of the listener image 303, the virtual spatial sound the user hears will simulate the change in spatial sound from the positional movement of the listener image 303. Not only will the user experience the sound as if moving from position one (where the first sound source is directly to the left and the second sound source is directly in front in close proximity) to position two (where the first sound source is directly to the left in close proximity and the second sound source is directly to the right in farther proximity), but the virtual spatial sound heard during the positional movement will simulate all the spatial attributes that were taken into account during processing, such as range, azimuth (ILD and ITD), elevation, reflections, reverberation, room size, wall density, etc.

Figure 3F:
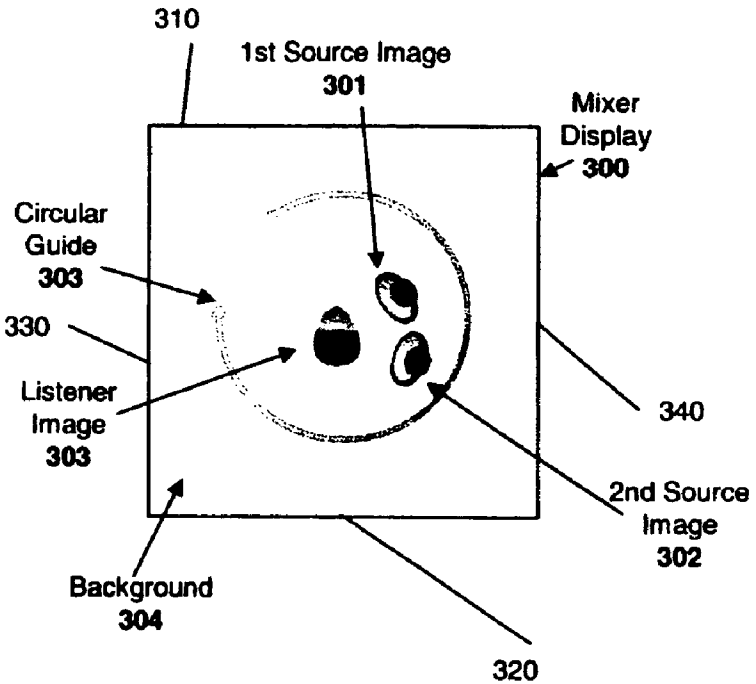
Figure 3E:
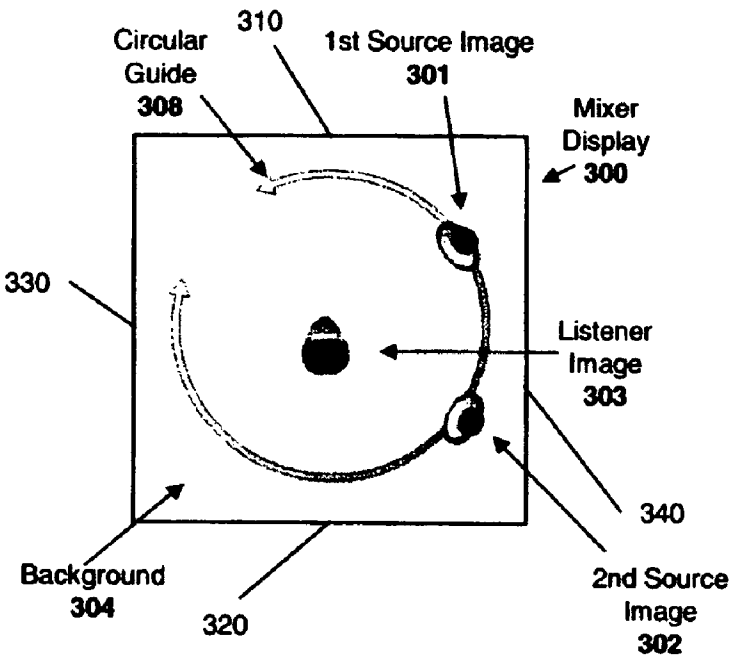

FIG. 3*e* illustrates a rotation of the first and second source images 301,302 within the room display 300. For example, a user may use a cursor control device to rotate the first and second source images 301,302 around an axis point, e.g., the center of the room display 300. A circular guide 308 may be generated to assist the user by indicating that the first and second source images 301,302 are ready to be rotated or is currently being rotated. The radius of the circular guide 308 determines the radius of the circle in which the first and second source images 301,302 may be rotated. Furthermore, the radius of the circular guide 308 may be dynamically changed as the first and second source images 301,302 are being rotated.

As shown in FIG. 3*e*, the first and second source images 301,302 are rotated clockwise from its position in FIG. 3*a* to its position in 3*e*. In the new position in FIG. 3*e*, the first source image 301 is now in front and to the right of the listener image 303, and the second source image 302 is now to the right and behind the listener image 303. Therefore, when the user listens to the output audio having spatial attributes associated with the new orientation, not only will the user experience the sound as if it were coming from a first sound source (to the right and in front) and from a second sound source (to the right and from behind), but the virtual spatial sound heard by the user will simulate all the spatial attributes that were taken into account during processing, such as range, azimuth (ILD and ITD), elevation, reflections, reverberation, room size, wall density, etc.

Furthermore, the rotational changes in orientation by the first and second source images 301,302 are sampled and processed at discrete intervals so to continually generate new output audio having spatial attributes for each new sampled orientation of the first and second source images 301,302 during the rotation of the first and second source images 301,302. Therefore, when a user listens to the output audio during the rotation of first and second source images 301,302, the virtual spatial sound the user hears will simulate the change in spatial sound from the rotation of the first and second source images 301,302. Not only will the user experience the sound as if the sound sources had rotated from position one (where a first sound source is to the front and left and a second sound source to the front and right) to position two (where the first sound source is to the right and in front and the second sound source is to the right and from behind), but the virtual spatial sound heard during the rotation will simulate all the spatial attributes that were taken into account during processing, such as range, azimuth (ILD and ITD), elevation, reflections, reverberation, room size, wall density, etc.

FIG. 3*f* illustrates a rotation of the first and second source images 301,302 within the room display 300 while decreasing the radius of the circular guide 308. The first and second source images 301,302 are rotated clockwise from its position in FIG. 3*a* to its position in 3*f*. As shown, the decrease in the radius of the circular guide 308 has rotated the first and second source images in a circular fashion with a decreasing radius around its axis point (e.g., the center of the room display, or alternatively the listener image). In the new position in FIG. 3*f*, the first source image 301 is now closer in proximity and located in front and to the right of the listener image 303, while the second source image 302 is now closer in proximity and to the right and behind the listener image 303. Therefore, when the user listens to the output audio having spatial attributes associated with the new orientations, not only will the user experience the sound as if it were coming from a first sound source (close in proximity to the right and in front) and from a second sound source (close in proximity to the right and from behind), but the virtual spatial sound heard by the user will simulate all the spatial attributes that were taken into account during processing, such as range, azimuth (ILD and ITD), elevation, reflections, reverberation, room size, wall density, etc.

Furthermore, the rotational changes in orientation by the first and second source images 301,302 are sampled and processed at discrete intervals so to continually generate new output audio having spatial attributes for each new sampled orientation of the first and second source images 301,302 during the rotation of the first and second source images 301,302. Therefore, when a user listens to the output audio during the rotation of first and second source images 301,302, the virtual spatial sound the user hears will simulate the change in spatial sound from the rotation of the first and second source images 301,302. Not only will the user experience the sound as if the sound sources had rotated from position one (where a first sound source is to the front and left, and a second sound source is to the front and right) to position two (where the first sound source is close in proximity to the right and in front, and the second sound source is close in proximity to the right and from behind), but the virtual spatial sound heard during the rotation will simulate all the spatial attributes that were taken into account during processing, such as range, azimuth (ILD and ITD), elevation, reflections, reverberation, room size, wall density, etc.

Spatial Audio Processing

The spatial module 209, of FIG. 2, includes an audio processing module 211. The audio processing module 211 allows for an audio processing pipeline to be split into a set of individual processing tasks. These tasks are then chained together to form the entire audio processing pipeline. The engine then manages the synchronized execution of individual tasks, which mimics a data-pull driven model. Since the output audio is generated at discrete intervals, the amount of data required by the output audio determines the frequency of execution for the other processing tasks. For example, outputting 2048 audio samples at a sample rate of 44100 Hz corresponds to about 46 ms of audio data. So approximately every 46 ms the audio pipeline will render a new set of 2048 audio samples.

The size of the output buffer (in this case 2048 samples) is a crucial parameter for the real-time audio processing. Because the audio pipeline must respond to changes in the source image and listener image positions and/or listener image rotation, the delay between when the orientation change is made and when this change is heard is critical. This is referred to as the update latency and if it too large the listener will be aware of the delay, that is the sound source will not appear to be moving as the listener moves the source from the user-interface. The amount of allowable latency is relative and may vary, but values between 30-100 ms are typically used.

Figure 4:
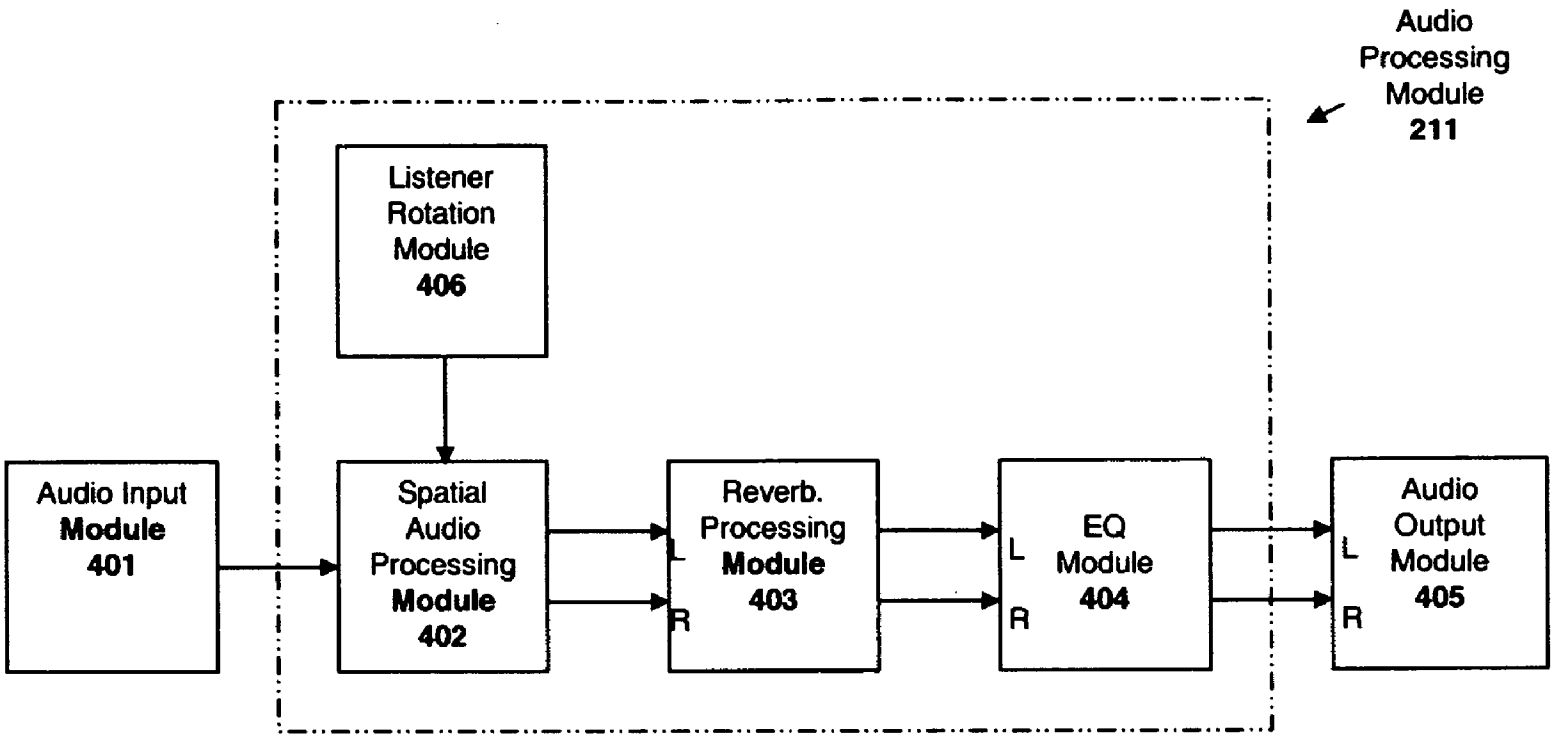
FIG. 4 illustrates a block diagram of audio processing module 211, according to one embodiment of the invention.

FIG. 4 illustrates a block diagram of audio processing module 211, according to one embodiment of the invention. In this exemplary embodiment, a box is placed around the tasks that comprise the real-time audio processing. The audio processing module 211 includes a pipeline of processing modules performing different processing tasks. As shown, audio processing module 211 includes an audio input module 401, a spatial audio processing module 402, reverb processing module 403, and equalization module 404, and audio output module 405 communicably coupled in a pipelined configuration. Additionally, listener rotation module 406 is shown communicably coupled to spherical head processing module 402.

As stated before, it should be appreciated that individual modules may be combined without compromising functionality. Thus, the underlying principles of the invention are not limited to the specific modules shown. Furthermore, additional audio processing modules may be added onto the pipeline.

Audio input module 401 decodes input audio coming from a file, a remote audio stream (e.g. from internet server 208 via internet 207), virtual audio cable, etc. and outputs the raw audio samples for spatial rendering. For example, a virtual audio cable (VAC) can be used to capture audio generated in a web browser which may not otherwise be easily accessible (e.g., a flash-based audio player on MySpace™). A VAC is typically used to transfer the audio from one application to another. For, example, you can play audio from an online radio station and in a separate application you can record this audio. The VAC will also allow other applications to send input audio to the audio processing module 211.

The spatial audio processing module 402 receives input audio from audio input module 401 and performs the bulk of the spatial audio processing. The spatial audio processing module 402 is also communicably coupled to listener rotation module 406, which communicates with peripherals 204 for controlling the rotation of listener image 303. Listener rotation module 406 provides the spatial audio processing module 402 with rotation input for the listener image 303.

Figure 5:
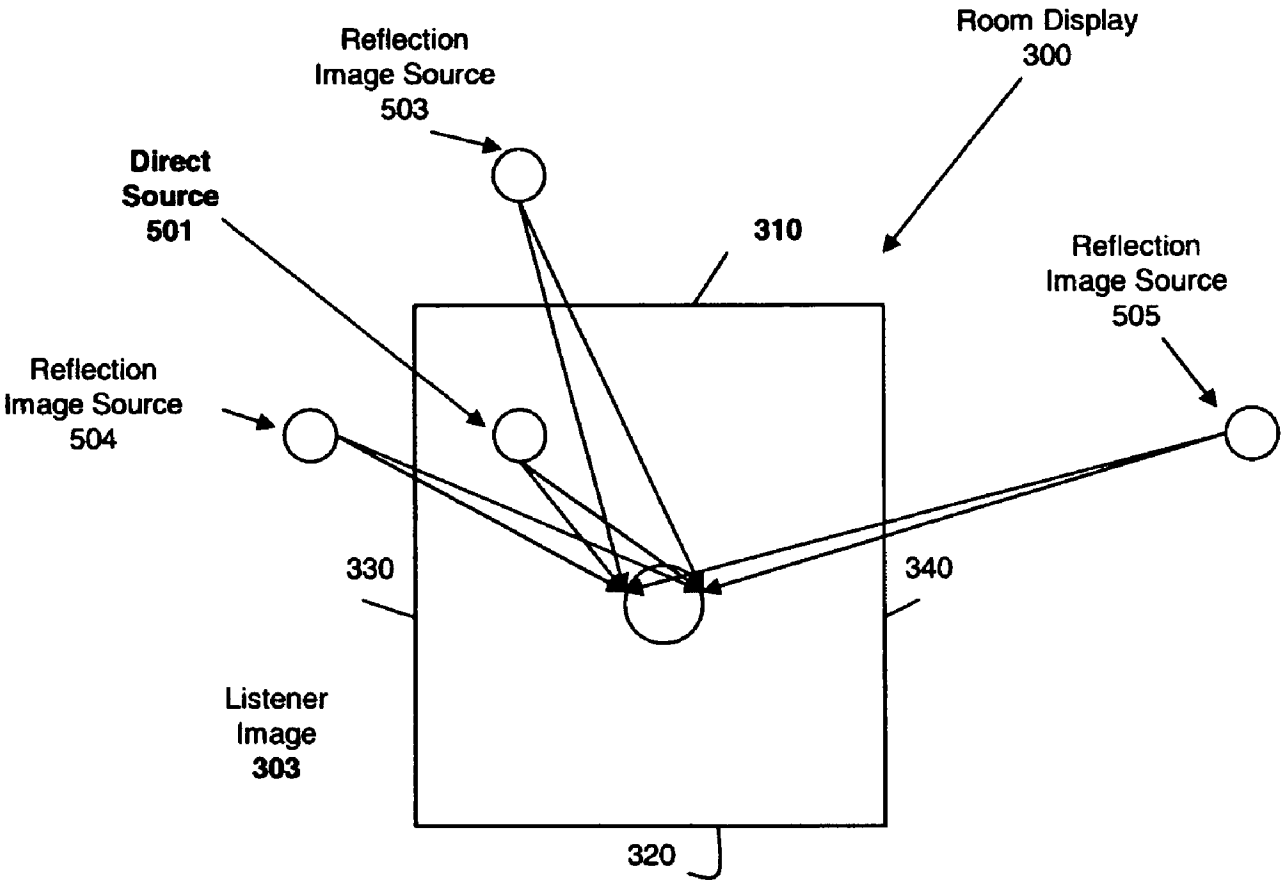
FIG. 5 illustrates reflection images for walls of room.

The spatial audio processing module 402 implements spatial audio synthesizing algorithms. In one embodiment, the spatial audio processing module 402 implements a modeled-HRTF algorithm based on the spherical head model (hereinafter referred to as the "spherical head processing module"). To simulate room acoustics, the spherical head processing module implements a standard shoebox room model where source reflections for each of the six walls are modeled as image sources (hereinafter referred to as 'reflection images'). FIG. 5 illustrates reflection images 503,504,505 for walls 310,330,340 of room display 300, according to one embodiment of the invention. Reflection images also exist for the other 3 walls but are not shown.

The first source image 301 and each of the reflection images 503,504,505 are shown having two vector components, one for the left and right ear. The sum of the direct source (i.e., first source image) and reflection image sources (both shown and not shown) produce the output for a single source. Since the majority of the content is stereo (2 channels), a total of 14 sources are processed (2 for the direct source, i.e., first source image; and 12 reflection image sources). Note that as the position of the direct source (i.e., first source image) changes in the room, the corresponding reflective image sources are automatically updated. Additionally, if the positional orientation of the listener image 303 changes, then the direction vectors for each source are also updated. Likewise, if the listener image 303 is rotated (change in the forward facing direction), the direction vectors are again updated.

In another embodiment, the spatial audio processing module 402 implements an algorithm used in the generation of motion-tracked binaural sound.

Reverberation processing module 403 introduces the effects of ambiance sounds by using a reverberation algorithm. The reverberation algorithm may, for example, be based on a Schroeder reverberator.

Equalization module 404 further processes the input audio by passing it through frequency band filters. For example, a three band equalizer for low, mid, and high frequency bands may be used.

Audio output module 406 outputs the output audio having spatial attributes associated with it. Audio output module 406 may, for example, take the raw audio samples and write them to a computer's sound output device. The output audio may be played over speakers, including speakers within headphones.

As an audio source moves towards or away from a listener, a frequency shift is commonly perceived (depending on the velocity of the audio source relative to the listener). This is referred to as a Doppler Effect. To correctly implement a Doppler effect the audio data would need to be resampled to account for the frequency shift. This resampling process is a very computationally expensive operation. Furthermore, the frequency shift can change from buffer to buffer, so constant resampling would be required. Although the Doppler Effect is a natural occurrence, it is an undesired effect when listening to spatialized music as it can grossly distort the sound. It is thus desirable to get the correct alignment in the audio file, to eliminate any frequency shifts, and to eliminate discontinuities between buffers due to time-varying delays. Therefore, samples may be added or removed from the buffer (depending on the frequency shift). This operation is spread across the entire buffer. Since the amount of samples that are added or dropped can be quite large, a maximum value of samples is used, e.g., 15 samples. A maximum threshold value is chosen so that any ITD changes will be preserved from buffer to buffer, thus maintaining the first order perceptual cues for accurately locating the spatialized source. If more than the maximum threshold value of samples (e.g., 15 samples) are required to be added or removed, then the remaining samples are carried over to the next buffer. This is essential slowing down the update rate of the room. This means that the room effects are not perceived in the output until shortly after the source or listener position changes.

Figure 7:
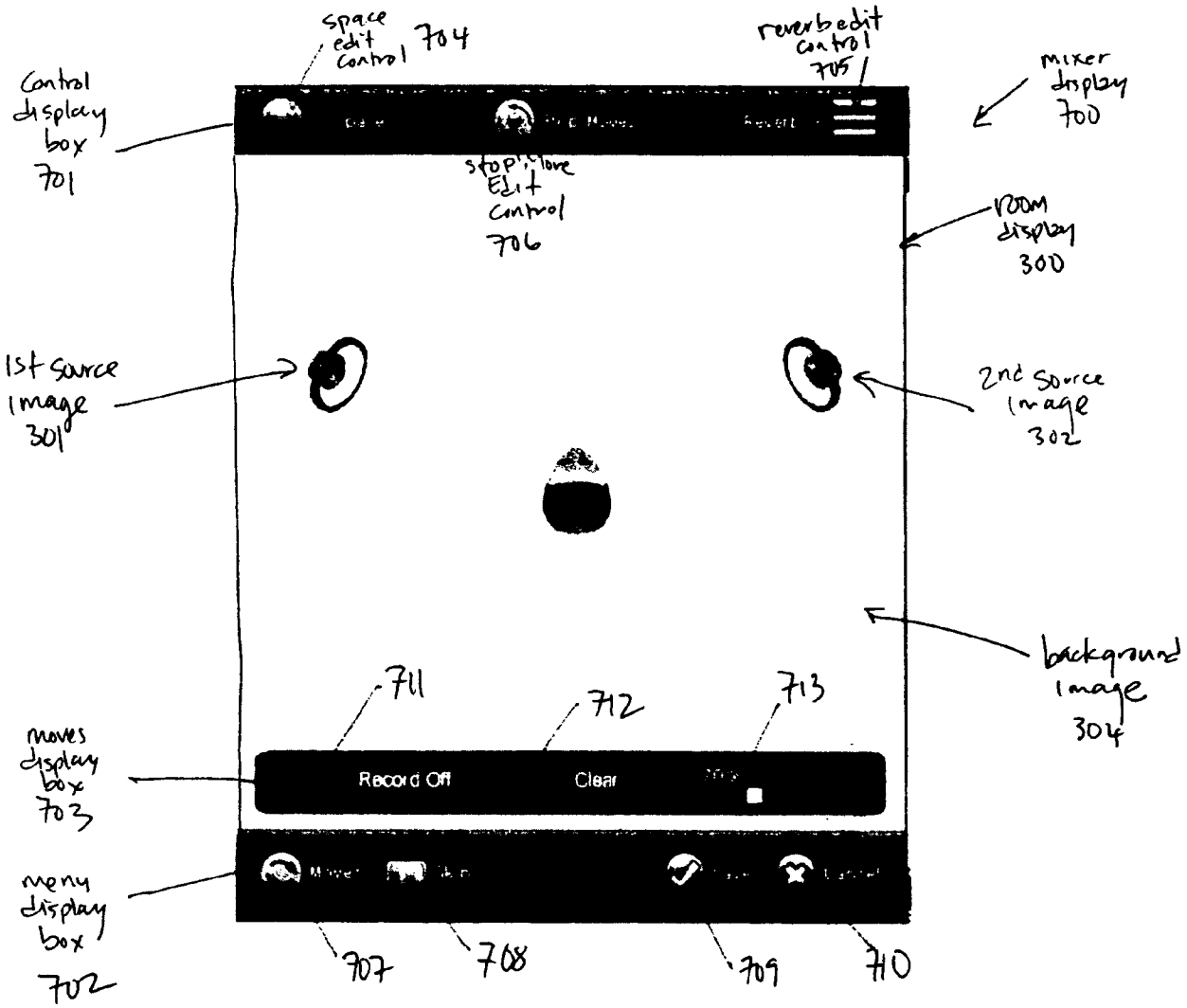
FIG. 7 illustrates a graphical user interface for a mixer display of an audio visual player, according to one embodiment of the invention.

FIG. 7 illustrates a graphical user interface portion generated by the display module 210, according to one embodiment of the invention. Shown in FIG. 7 is a mixer display 700 including a room display 300, control display box 701, menu display 702, and moves display 705. The room display 300 further includes a first source image 301, second source images 302, a listener image 303, and background 304. The discussion above pertaining to the room display 300 applies here as well. The background image 304 may be a graphical image, including a blank background image (as shown) or transparent background image. The background image 304 may also be video.

Mixer display 700 allows a user to perform audio motion edits. Audio motion edits are edits that relate generally to the room display 300 and spatial attributes. For example, audio motion edits may include the following:

1. Orientation Edit: An orientation edit is an edit to the orientation of any source image (e.g. first or second sound source image 301,302) or the listener image 303. While an orientation edit is being performed, the spherical head processing module 402 is performing the processing task to continually process the input audio so that the output audio has new associated spatial attributes that reflect each new orientation at the time of sampling, as described earlier when discussing audio processing.

2. Space Edit: A space edit simulates a change in room size, and may be performed by the space edit control 704 included in the control display box 701 shown in FIG. 7. The spherical head processing module 402 performs the processing task to process the input audio into output audio having associated spatial attributes that reflect the change in room size.

3. Reverb Edit: A reverb edit simulates a change in reverberation, and may be performed by the reverb edit control 705 included in the control display box 701 shown in FIG. 7. The reverb processing module 403 performs the processing task to process the input audio into output audio having associated spatial attributes that reflect the change in reverberation.

4. Image Edit: An image edit is an edit which changes any of the actual images used for the listener image 303 and/or source images (e.g., first and second source images 301,302). The image edit includes replacement of the actual images used and changes to the size and transparency of the actual images used. Edits to the transparency of the actual images may be performed by the image edit control 713 included in the moves display box 703 shown in FIG. 7. For example, the current image used for the listener image 303 (e.g., the image of a head shown in FIG. 7) may be replaced with a new image (e.g., a photo of a car). The actual image may be any graphical image or video.

In one embodiment, image edits do not affect the processing of input audio into output audio having spatial attributes. In another embodiment, image edits do effect the processing of input audio into output audio having new spatial attributes that reflect the edits. For example, increases or decrease in actual image sizes of the listener image 303 and first and second source images 301,302 may reflect an increase or decrease in elevation, respectively. Thus, if an audio processing task is included to process the input audio into output audio having new associated spatial attributes that reflect changes in elevation, then the elevation changes will be simulated. Alternatively, increases or decrease in the actual image sizes may reflect greater or less head shadowing, respectively. Likewise, an audio processing task will process the input audio into output audio having new associated spatial attributes that reflect the change in head shadowing.

5. Record edit: A record edit records any orientation edits, and may be performed by the record edit control 711 included in the moves display box 703 shown in FIG. 7. Furthermore, the orientation movement will be continuously looped after one orientation movement and/or after the record edit is complete. The input audio will be processed into output audio having associated spatial attributes that reflect the looping of the orientation movement. Additional orientation edits made after the looping of a previous orientation edit can be recorded and continuously looped as well, overriding the first orientation edit if necessary.

6. Clear Edit: A clear edit clears any orientation edits performed, and may be performed by the clear edit control included in the moves display box 703 shown in FIG. 7. The listener image 303 and/or source images (e.g., first and second source images 301,302) may return to an orientation existing at the time right before the orientation edit was performed.

7. Stop Move Edit: A stop move edit pauses any orientation movement that has been recorded and continually looped, and may be performed by the stop move control 706 included in the control display box 701 shown in FIG. 7. The listener image 303 and/or source images (e.g., first and second source images 301,302) stop in place however they are oriented at the time of the stop move edit.

8. Save Edit: A save edit saves motion data, visual data, and manifest data for creating a virtualprogram. (Virtualprograms are discussed in further detail below). The motion data, visual data, and manifest data for the virtualprogram are saved in virtualprogram data files for the virtualprogram. The save edit may be performed by the save edit control 709 included in the menu display box 702 shown in FIG. 7. This save edit applies equally to visual edits (discussed later).

Virtualprogram is used throughout this document to describe the specific configuration (including any configuration changes that are saved) of mixer display 700 and its corresponding visual elements, acoustic properties and motion data for spatial rendering of an audio file. The virtualprogram refers to the room display 300 properties and its associated spatial attributes (e.g., orientations of the listener image and source images, orientation changes to the listener image and source images, audio motion edits, visual edits (discussed below), and the corresponding spatial attributes associated with them). When the virtualprogram is created, an association to a specific audio file (whether from memory, media, or streamed from a remote site) is saved with it. Thus, each time the virtualprogram is played, the input audio for the specific audio file is processed into output audio having the spatial attributes for the virtualprogram. In one embodiment, when dealing with streaming audio from a remote site, the virtualprogram contains only the link to the remote stream and not the actual audio file itself. Also it should be noted that if any streaming video applies to the virtualprogram (e.g., video in the background), then only the links to remote video streams are contained in the virtualprogram.

Despite the virtualprogram having a specific associated audio file saved to it, the virtualprogram may be used with a different audio file in order to process the input audio for the different audio file into output audio having the spatial attributes for the virtualprogram. Virtualprograms may be associated to other audio files by, for example, matching the virtualprogram with audio files in a library (discussed in further detail later when discussing libraries). Thus, each time the different audio file associated with the virtualprogram (but not saved to the virtualprogram) is selected to be played, the virtual program is loaded and played, and the input audio for the different audio file (and not the audio file saved within the virtualprogram) is processed into output audio having the spatial attributes of the virtualprogram.

For new associations, the virtualprogram data files for the virtualprogram may be altered slightly in order to reflect the association with the second audio file (e.g., the manifest data may be altered to reflect the second audio file name and its originating location). However, the association of the virtualprogram with a different audio file does not change the virtualprogram's specific associated audio file saved to it, unless the virtualprogram is resaved with the different audio file. Alternatively, it may be saved as a new virtualprogram having the different associated audio file saved to it.

9. Cancel Edit: A cancel edit cancels any edits performed and returns the mixer display 700 to an initial configuration before any edits were performed. The cancel edit may be performed by the cancel edit control 710 included in the menu display box 702 shown in FIG. 7. For example, the initial configuration may be the configuration that existed immediately before the last edit was performed, the configuration that existed when an audio file began playing, or an initial configuration. The initial configuration is any preset configuration. For example, it may be the configuration existing when an audio file begins playing, or it may be a default orientation. This applies equally to visual edits (discussed later).

Menu display 702 is also shown to include a move menu item 707 and a skin menu item 708. Move menu item 707, when activated, displays the moves display box 703. The skin menu item 708, when activated, displays the visual edits box (shown in FIG. 8).

Figure 8:
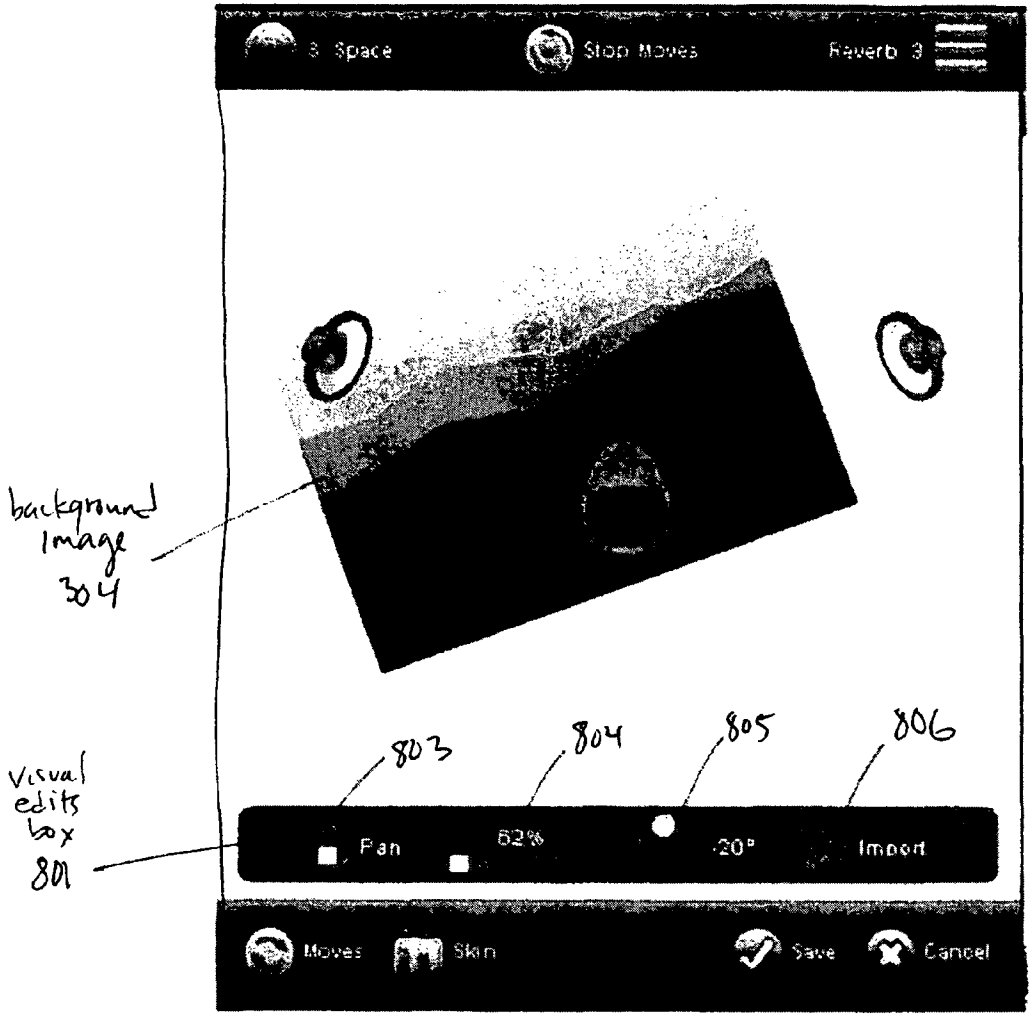
FIG. 8 illustrates a graphical user interface for a mixer display of an audio visual player, according to one embodiment of the invention.

FIG. 8 illustrates a graphical user interface portion generated by the display module 210, according to one embodiment of the invention. The mixer display 700 in FIG. 8 is identical to the mixer display 700 in FIG. 7, except that a visual edits box 801 is displayed in place of the moves display box 703, and furthermore, the background image 304 is different (discussed further below). Discussions for FIG. 7 pertaining to aspects of mixer display 700 that are in both FIG. 7 and FIG. 8, apply equally to FIG. 8. The different aspects are discussed below.

Mixer display 700 allows a user to perform visual edits. Visual edits are edits that relate generally to the appearance of the room display 300. For example, visual edits may include the following:

1. Size Edit: A size edit increases or decreases the size of the background image 802, and may be performed by the size edit control 804 included in the visual edits box 703 shown in FIG. 7. As shown in FIG. 8, the background image 304 has been decreased in size to be smaller than the size of the room display.

2. Background Rotation Edit: A background rotation edit rotates the background image 802, and may be performed by the background rotation edit control 803 included in the visual edits box 703 shown in FIG. 7. As shown in FIG. 8, the background image 304 has been rotated in the room display 300.

3. Pan Edit: A pan edit pans the background image 802 (i.e. changes its position), and may be performed by the pan edit control 803 included in the visual edits box 703 shown in FIG. 7.

4. Import Edit: An import edit imports a graphical image or video file (either from storage or received remotely as a video stream) as the background image 802, and may be performed by the import edit control 803 included in the visual edits box 703 shown in FIG. 7. For example, import edit may allow a user to select a graphical image file, video file, and/or link (to a remote video stream) from memory or a website.

Figure 9:
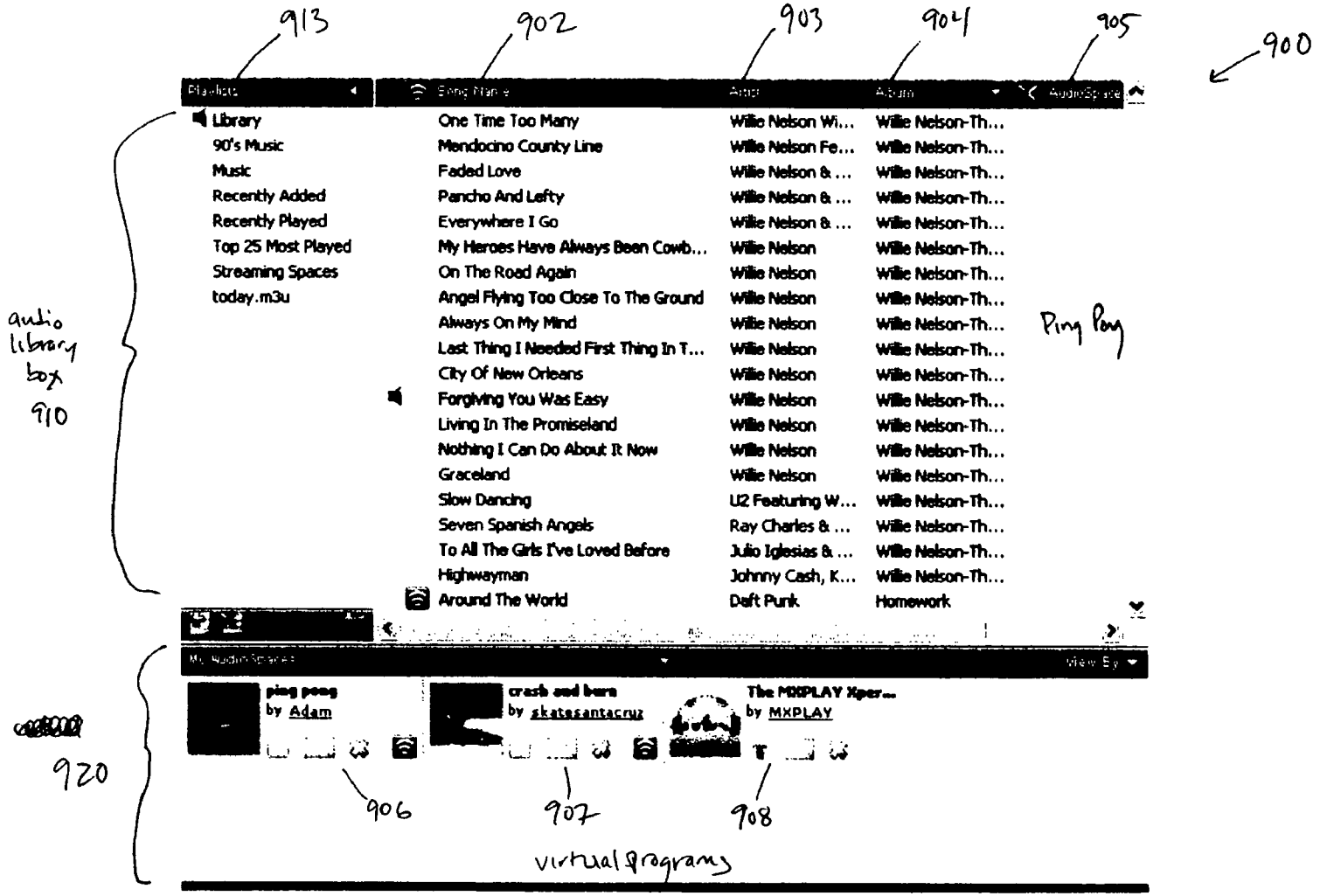
FIG. 9 illustrates a graphical user interface for a library display of an audio visual player, according to one embodiment of the invention.

FIG. 9 illustrates a graphical user interface for a library display 900 of an audio visual player, according to one embodiment of the invention. In this embodiment, the library display 900 includes an audio library box 910 and virtualprograms box 920.

The audio library box 910 lists audio files that are available for playback in column 902. Columns 903,904,905 list any associated artists, albums, and virtualprograms, respectively. For instance, audio file "Always on My Mind" is associated with the artist, "Willie Nelson" and the virtualprogram named "Ping Pong." Furthermore, audio library box 910, as shown, includes a stream indicator 909 next to any audio file listed in column 902 that originates and can be streamed from a remote audio stream (e.g., an audio file streamed from an internet server 208 over the internet 207). Therefore, the library box 910 not only lists audio files stored locally in memory, but also lists audio files that originate and can be streamed from a remote location over the internet. For the streaming audio, only the link to the remote audio stream, and not the actual audio file, is stored locally in memory. In one embodiment, the streaming audio file may be downloaded and stored locally in memory and then listed in the library box 910 as an audio file that is locally stored in memory (i.e., not listed as a remote audio stream).

The audio files listed may or may not have a virtualprogram associated with it. If associated with a virtualprogram, then upon selection of the audio file to be played, the virtualprogram will be loaded and played, and the input audio for the associated audio file is processed into output audio having spatial attributes associated with the virtual program.

As discussed earlier, the motion data, visual data, and manifest data for a virtualprogram are saved in virtualprogram data files. Additionally, any links associated with remotely streamed audio or video will be contained within the virtualprogram data files. Further detail for the motion data, visual data, and manifest data are provided later. The virtualprogram associated with an audio file allow that specific configuration of the mixer display 700 to be present each time that particular audio file or virtualprogram is played, along with all of the corresponding spatial attributes for the virtualprogram.

A virtualprogram may be associated with any other audio file (whether stored in memory, read from media, or streamed from a remote site) listed in the library display 900. For example, the virtualprogram may be dragged and dropped within column 905 for the desired audio file to be associated, thus listing the virtualprogram in column 905 and associating it with the desired audio file. Thereafter, the desired audio file is associated with the virtualprogram, and when selected to be played, the virtualprogram is loaded and played, and the input audio for the desired audio file is processed into output audio having spatial attributes of the virtualprogram. It should be understood that any number of audio files may be associated with the virtualprogram data files of a virtualprogram. As explained earlier, the newly associated audio file is not saved within the virtualprogram unless the virtualprogram is resaved with the newly associated audio file. Alternatively, the new association may be saved as a new virtualprogram having the newly associated audio file saved to it.

Virtualprograms and their virtualprogram data files may be saved to memory or saved on a remote server on the internet. The virtualprograms may then be made available for sharing, e.g., by providing access to have the virtualprogram downloaded from local memory; by storing the virtualprogram on a webserver where the virtualprogram is accessible to be downloaded; by transmitting the virtualprogram over the internet or intranet; and by representing the virtualprogram on a webpage to provide access to the virtualprogram.

For example, users may log into a service providing such a service and all virtualprograms created can be stored on the service provider's web servers (e.g., within an accessible pool of virtual programs; and/or within a subscriber's user profile page stored on the service provider's web server). Virtualprograms may then be accessed and downloaded by other subscribers of the service (i.e., shared among users). Users may also transmit virtualprograms to other users, for example by use of the internet or intranet. This includes, for example, all forms of sharing ranging from instant messaging, emailing, web posting, etc. Alternatively, a user may provide access to a shared folder such that other subscribers may download virtualprograms from the user's local memory. In yet another example, a virtualprogram may be displayed on a webpage via a representative icon, symbol, hypertext, etc., to allow visitors of the website to select and access the virtualprogram. In such case, the virtualprogram will be opened up in the audio visual player on the visitor's computer. If the visitor does not have the audio visual player installed, the visitor will be provided with the opportunity to download the audio visual player first.

In one embodiment, the shared virtualprograms only include links to any video or audio streams and not the actual audio or video file itself. Therefore, when sharing such virtualprogram, only the link to the audio or video stream is shared or transmitted and not the actual audio or video file itself.

In one embodiment, a video lock, audio lock, and/or motion lock can be applied to the virtualprograms and contained within the virtualprogram data files. If the video is locked, then the visual elements cannot be used in another virtualprogram. Similarly, if the audio is locked, then the audio stream cannot be saved to another virtualprogram. If the motion is locked, then the motion cannot be erased or changed.

The audio library box 910, as shown in FIG. 9, also includes column 913 which lists various playlist names. Playlists are a list of specific audio files. The playlist may list audio files stored locally in memory, and/or may list audio files that originate and can be streamed from a remote location over the internet (i.e., lists remote audio streams). Thus, a user my build playlists from streams found on the internet and added to the library.

Furthermore, each audio file listed may or may not be part of a virtualprogram. However, if any specific audio files in the playlist is matched with a virtualprogram (i.e. associated with a virtualprogram), then the association is preserved.

Therefore, upon playback of the playlist, each of the specific audio files listed in the playlist will be played in an order. The input audio for each of the audio files in the playlist will be processed into output audio. The input audio for any of the audio files in the playlist that are associated with a virtualprogram will be processed into output audio having the spatial attributes for the virtualprogram (since the virtualprogram will be loaded and played back for those associated audio files).

Playlists may be saved locally in memory or remotely on a server on the internet or intranet. The playlists may then be made available for sharing, e.g., by providing access to have the playlist downloaded from local memory; by storing the playlist on a webserver where the playlist is accessible to be downloaded; by transmitting the playlist over the internet or intranet; and by representing the playlist on a webpage to provide access to the playlist.

For example, users may log into a service providing access to playlists and all playlists created can be stored on the service provider's web servers (e.g., within an accessible pool of playlists; and/or within a subscriber's user profile page stored on the service provider's web server). Playlists may then be accessed and downloaded by other subscribers of the service (i.e., shared among users). Alternatively, a user may provide access to a shared folder such that other subscribers may download playlists from the user's local memory. Users may also share playlists by transmitting playlists to other users, for example by use of the internet or intranet. This includes, for example, all forms of sharing ranging from instant messaging, emailing, web posting, etc. In yet another example, a playlist may be displayed on a webpage via a representative icon, symbol, hypertext, etc., to allow visitors of the website to select and access the playlist. In such case, the playlist will be opened up in the audio visual player on the visitor's computer. If the visitor does not have the audio visual player installed, the visitor will be provided with the opportunity to download the audio visual player first.

In one embodiment, the shared playlists only include links to any audio or video streams and not the actual audio or video file itself. Therefore, when sharing such playlists, only the link to any audio or video stream is shared or transmitted and not the actual audio or video file itself.

Virtualprograms box 920 is shown to include various virtualprograms 906,907 named "Ping Pong" and "Crash and Burn," respectively. Virtualprograms may be selected and played (e.g., by double-clicking), or associated with another audio file (e.g., by dragging and dropping the virtual program onto a listed audio file). However, various ways to select, play, and associate the virtualprogram data files may be implemented without compromising the underlying principles of the invention.

Figure 10:
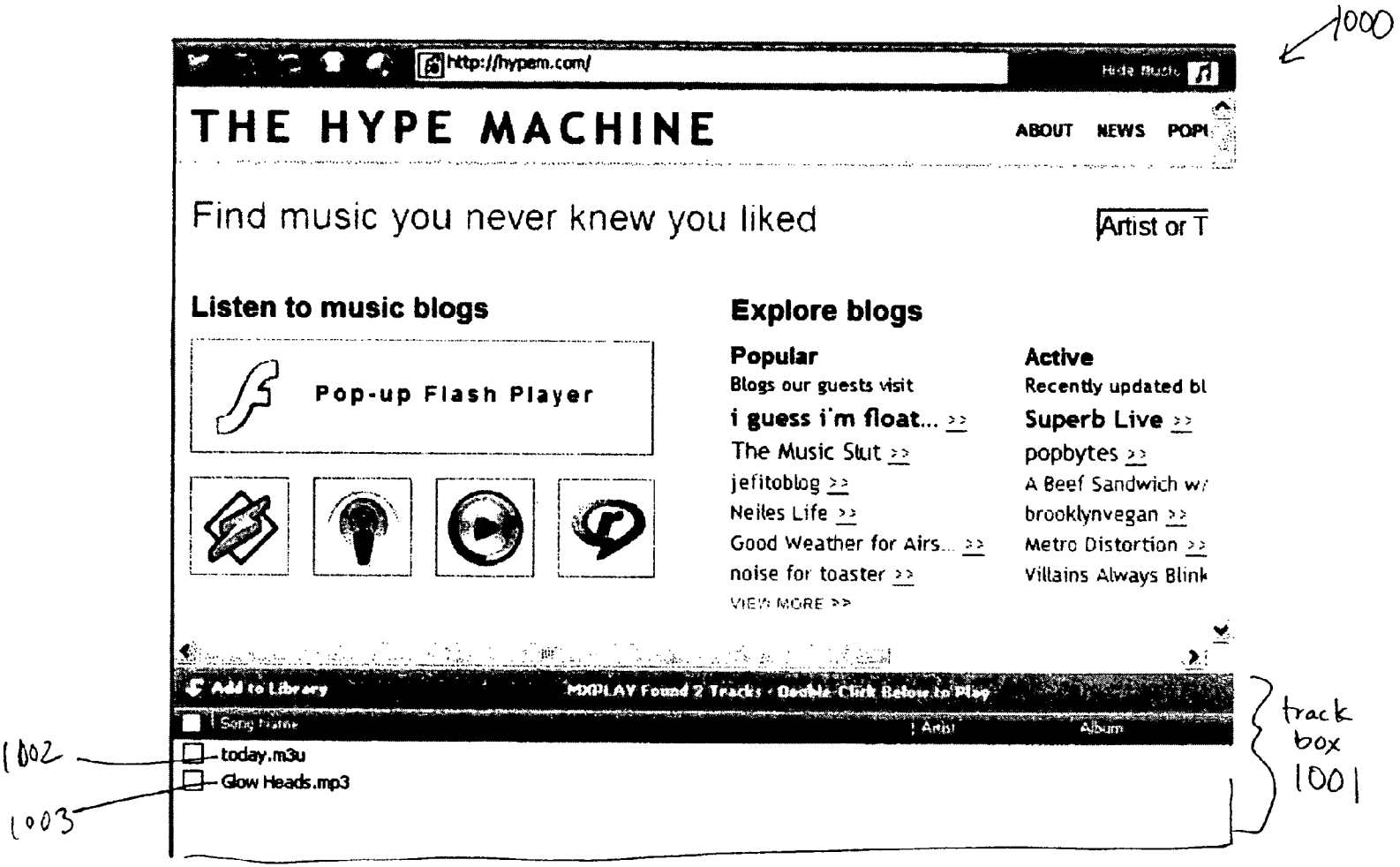
FIG. 10 illustrates a graphical user interface for a web browser display of an audiovisual player, according to one embodiment of the invention.

FIG. 10 illustrates a graphical user interface portion for an audiovisual player displaying a web browser display 1000, according to one embodiment of the invention. The web browser display 1000 contains all the feature of a typical web browser. In addition, the web browser display 1000 includes a track box 1001 which displays a list of audio streams, video streams, and/or playlists that are available on the current web page being viewed. As shown, track box 1001 contains file 1002 which is an .m3u file named "today." Also shown is file 1003 which is an .mp3 file named "Glow Heads." These files may be selected and played (e.g., by double clicking). In one embodiment, the link for the remote stream may be saved to the library display 900. In another embodiment, the audio file may be downloaded and saved to memory.

While only .mp3 and .m3u file formats are shown in FIG. 10, other file formats may be present without compromising the underlying principles of the invention. Audio files may include, for example, .wav, .mp3, .aac, .mp4, .ogg, etc. Furthermore, video files may include, for example, .avi, .mpeg, .wmv, etc.

Figure 11:
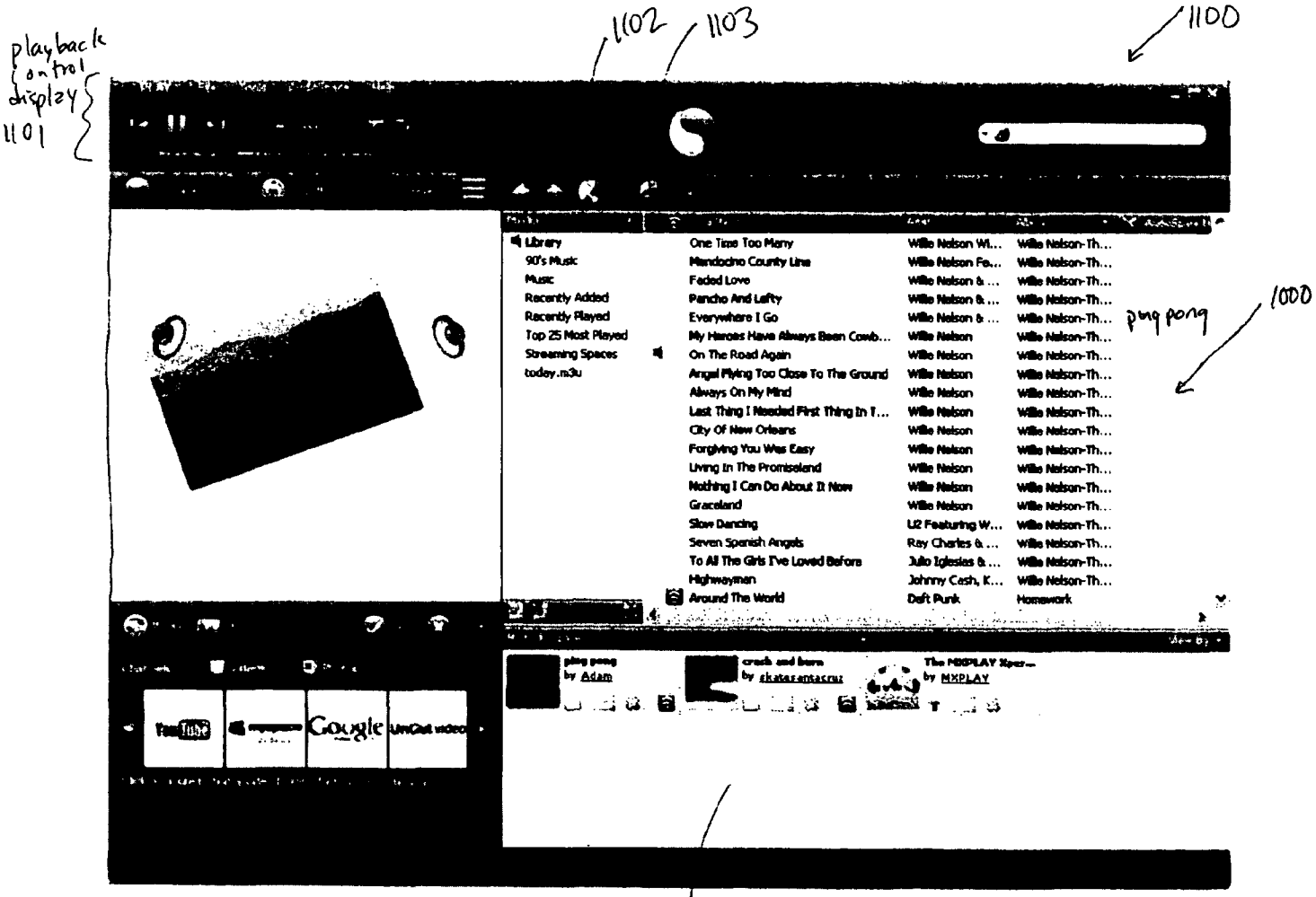
FIG. 11 illustrates a graphical user interface for an audio visual player, according to one embodiment of the invention.

FIG. 11 illustrates a graphical user interface for an audio visual player, according to one embodiment of the invention. The audio visual player display 1100 includes a library display 1000 (including virtualprograms box 920), mixer display 700, and playback control display 1101. Playback control display 1101 displays the typical audio control functions which are associated with playback of audio files.

Audio visual player display also includes a web selector 1102 and library selector 1103 which allow for the web browser display 1000 and library display 900 to be displayed, respectively. While in this exemplary embodiment, the library display 900 and the web browser display 1000 are not simultaneously displayed, other implementations of audio visual player display 1100 are possible without compromising the underlying principles of the invention (e.g., displaying both the library display 900 and the web browser display 1000 simultaneously).

The audio visual player thus allows a user to play audio and perform a multitude of tasks within one audio visual display 1100. For example, the audio visual player allows a user to play audio or virtualprograms with spatial attributes associated with it, manipulate spatial sound, save virtualprograms associated with the audio file, associate virtualprograms with other audio files in the library, upload virtual programs, share virtualprograms with other users, and share playlists with other users.

Figure 12:
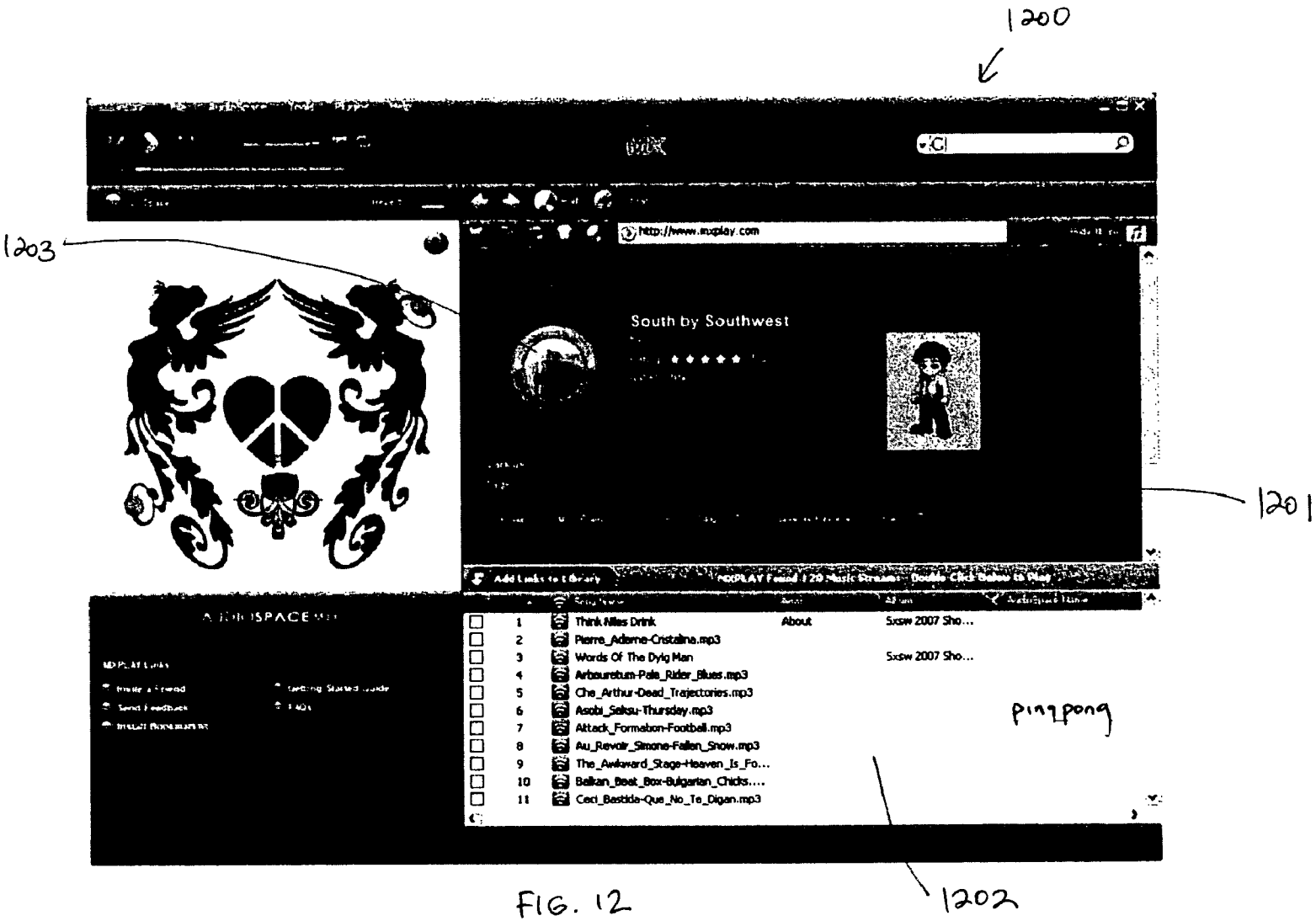
FIG. 12 illustrates a playlist page displayed in a web browser display, according to one embodiment of the invention.

FIG. 12 illustrates a playlist page 1200 displayed in web browser display 1000, according to one embodiment of the invention. The playlist page may, for example, be stored in a user's profile page on a service provider's web server. The playlist page 1200 is shown to include a playlist information box 1201 and playlist track box 1202.

Playlist information box 1201 contains general information about the playlist. For example, it may contain general information like the name of the playlist, the name of the subscriber who created it, its user rating, its thumbnail, and/or some general functions that the user may apply to the playlist (e.g., share it, download it, save it, etc.).

Playlist track box 1202 contains the list of audio files within that specific playlist and any virtualprograms associated with the audio files. The playlist track box 1202 will display all the streaming audio and video files found on the current web page. Therefore, the list of audio files are displayed in the playlist track box 1202. In one embodiment, the list of streaming audio files are displayed in the same manner as it would be displayed in the library (e.g., with all the associated artist, album, and virtualprogram information). For example, in FIG. 12, the streaming audio file called "Asobi_Seksu-Thursday" is associated with the virtualprogram called "Ping Pong."

A user viewing the playlist page 1200 can start playing the audio streams immediately without having to import the playlist. The user can thus view and play the audio files listed in order to decide whether to import the playlist.

A get-playlist control 1203 is displayed to allow a user to download a playlist. The entire playlist or only certain audio files may be selected and added to a user's library. If an audio file listed in the playlist is associated with the virtualprogram, then the virtualprogram is shared as well. If the user already has the audio file in his library but not the associated virtualprogram, then the virtualprogram may be downloaded.

In one embodiment, only the link for the remote audio and/or video streams are shared and not the actual audio and/or video files. In another embodiment, the audio and/or video files may be shared by a user downloading and saving it to local memory.

Figure 13:
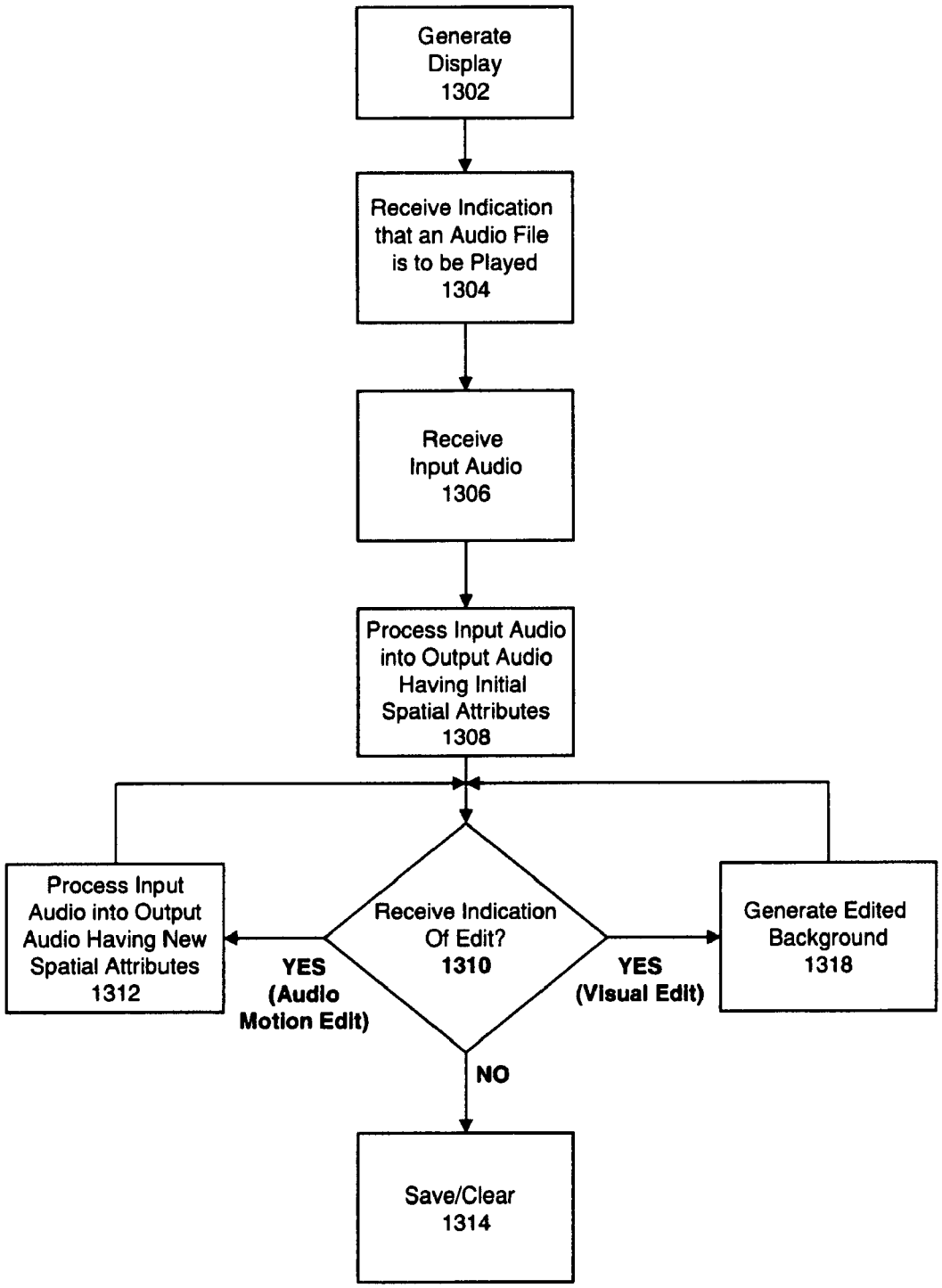
FIG. 13 illustrates a flow chart for creating a virtualprogram.

FIG. 13 illustrates a flow chart for creating a virtualprogram, according to one embodiment of the invention. The process for creating a virtualprogram is generally discussed below and earlier discussions still apply even if not explicitly stated below.

At block 1302, display module 210 generates a room display 300 including a background image 304, a listener image 303, and at least one source image (e.g., first and second source images 301,302). The initial orientation having initial spatial attributes associated with it. In one embodiment, the room display 300 is generated within a mixer display 700 which has additional features which add to the initial spatial attributes. (For example, the reverb edit control 705 and space edit control 704).

At block 1304, detection module 212 receives an indication that an audio file is to be played. At block 1308, audio processing module 211 receives input audio, and then at block 1308, the input audio is processed into output audio having initial attributes associated with it. At block 1310, the detection module 212 waits for an indication of an edit. If, at block 1310, the detection module 212 receives an indication that an audio motion edit is performed, the audio processing module 211 process then begins to process the input audio into output audio having new spatial attributes that reflect the audio motion edit performed, as shown at block 1312. The detection module 212 again waits for an indication of an edit, as shown in block 1310. If an indication of a visual edit is detected at 1310, then an edited background is generated, at block 1318, that reflects the visual edit that was performed. The detection module 212 again waits for an indication of an edit, as shown in block 1310. If no edit is performed and the audio file is finished playing, then edits can be saved or cleared, as shown at block 1314. In addition, edits may be saved immediately following the performance of the edit. Any edits performed and saved are saved within a virtualprogram. The edits will be saved within virtualprogram data files for the virtualprogram. Therefore, the configuration, including any saved configuration changes, of room display (or mixer display) will be saved and reflected in the virtualprogram. Multiple edits may exist and the resulting configuration saved to the virtual program. For instance, the background image may edited to include a continuously looping video, while at the same time, the orientations of images in the room display may be edited to continuously loop into different positions and/or rotations. A saved virtualprogram will include the motion data and visual data for the edits (as well as manifest data) within the virtualprogram data files.

Furthermore, upon saving to the virtualprogram, the audio file (whether from memory, media, or streamed from a remote site) is associated with the virtualprogram and the association is saved within the virtualprogram data files. In one embodiment, only the links to any streaming audio or video is included within the virtualprogram data files. Upon receiving an indication to play the virtual program, the virtualprogram will be loaded and played with the newly saved configuration. At the same time, the associated audio file is played such that the input audio from the audio file is processed into output audio having the newly saved spatial attributes for the virtualprogram.

Although the virtualprogram includes an associated audio file saved within it. The virtualprogram may be associated with a different audio file (as discussed earlier). Thus, each time the different audio file associated with the virtualprogram (but not saved to the virtualprogram) is selected to be played, the virtual program is loaded and played, and the input audio for the different audio file (and not the audio file saved within the virtualprogram) is processed into output audio having the spatial attributes of the virtualprogram.

As stated earlier, for new associations, the virtualprogram data files for the virtualprogram may be altered slightly in order to reflect the association with the second audio file (e.g., the manifest data may be altered to reflect the second audio file name and its originating location). However, the association of the virtualprogram with a different audio file does not change the virtualprogram's specific associated audio file saved to it, unless the virtualprogram is resaved with the different audio file. Alternatively, it may be saved as a new virtualprogram having the different associated audio file saved to it.

It will be appreciated that the display portions of the graphical user interfaces discussed above that include the word "box" in its title (e.g., moves display box 703, menu display box 704, control display box 701, visual edits box 801, audio library box 910, virtualprograms box 920, track box 1001, playlist information box 1201, playlist track box 1202, etc.) are not limited to the shape of a box, and may thus be any particular shape. Rather, the word "box" in this case is used to refer to a portion of the graphical user interface that is displayed.

Exemplary Virtualspace Data File Format

An exemplary file format structure for virtualprogram data files are discussed below. This particular example is shown to include two channels and two source images. It should be understood that deviations from this file format structure may be used without compromising the underlying principles of the invention.

The uncompressed directory structure of the virtualprogram data files is as follows:

```
Motion <directory>
    File0chan0trans.xybin
    File0chan1trans.xybin
    Listrotate.htbin
    Listtrans.xybin
Visuals <directory>
    Up to 4 images (background, listener, source1, source2)
    moviedescrip.xml
    movies.xml
Manifest.xml
Thumbnail.jpg
```

The motion directory contains the motion data files. These are binary files that contain the sampled motion data. The sampling rate used may be, for example, approx. 22 Hz which corresponds to a sampling period of 46 ms. In one embodiment, a room model is used that only places sources and the listener in the horizontal plane (fixed z-coordinate). In such case, only (x,y) coordinates are sampled. In another embodiment, the (x,y,z) coordinates are sampled.

The source image and listener image translational movement (also referred to as positional movement) is written to a binary file in a non-interlaced format. The first value written to the file is the total number of motion samples. The file structure is shown below.

The listener image translation data is stored in the listtrans.xybin file. The source image translation data files have a dynamic naming scheme since there is a possibility of having more than one audio file and each file can have any number of audio channels. Therefore, these data files contain the file # and the channel #, FileXchanNtrans.xybin (X=the file number, N=the channel number in the file).

An additional motion element is the listener image rotation value. This data is a collection of single rotation values representing the angle between the forward direction (which remains fixed) and the listener image's forward-facing direction. The rotation values range from 0 to 180 degrees and then go negative from −180 to 0 degrees in a clockwise rotation.

The listener image rotation values are sampled at the same period as the translation data. The rotation file is also a binary file with the first value of the file being the number of rotation values followed by the rotation data as shown below. This data is stored in the listrotate.htbin file.

The visuals directory contains the necessary elements for displaying the background image, the listener image, and source images within the room display 300.

The moviedescrip.xml file is used by the Flash visualizer to retrieve the visual elements and their attributes (pan, width, height, rotation, alpha, etc.). Flash video may also be used in place of a background image. In one embodiment, only a link to the video file is provided in the moviedescrip.xml file. The video is then streamed into the player during playback. This also allows video to be seen by other subscribers when the virtualprograms, and thus virtualprogram data files, are shared. The videos typically come from one of the many popular video websites that are available (i.e. YouTube™, Google Video™, MetaCafe™, etc).

The manifest.xml contains general information about the virtualprogram such as the name, author, company, description, and any of its higher level attributes. These attributes contain the acoustic properties (room size and reverberation level) of the room and any video, audio, or motion lock. Just as video can be streamed in the background of the room display 300, the manifest supports an attribute for a streaming audio link. When this link is being used, the virtualprogram becomes a "streaming" virtualprogram in the sense that the audio will be streamed to the player during playback.

Lastly, the individual visual elements all have a universally unique identifier. These UUIDs are preserved in current virtualprograms and any derivative virtualprograms so that it may be easy to track how frequently certain elements are used or viewed.

The thumbnail is a snapshot taken of the room display 300 when it is saved. This image is then used wherever virtualprograms are displayed in the virtualprograms box 920 and on any web pages.

It will be appreciated that the above-described system and method may be implemented in hardware or software, or by a combination of hardware and software. In one embodiment, the above-described system and method may be provided in a machine-readable medium. The machine-readable medium may include any mechanism that provides information in a form readable by a machine, e.g. a computer. For example, a machine-readable medium may include read only memory (ROM); random access memory (RAM), magnetic disk storage media; optical storage media; flash memory devices; electrical, optical, acoustical or other form of propagated signals (e.g., carrier waves, infrared signals, digital signals, etc.); etc.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. The method comprising:

generating a room display including a background image, a listener image, and at least one source image, wherein the listener image and at least one source image are displayed in an initial orientation, the initial orientation having initial spatial attributes associated with it;

receiving an indication of a first audio file to be played with the initial spatial attributes;

receiving input audio for the first audio file; and processing the input audio into output audio having the initial spatial attributes;

wherein processing of the input audio includes a processing task for sampling the orientations of the listener image and the at least one source image, the sampling used to determine a source azimuth and first order reflections for each of the at least one source image within the room display.

2. The method of claim 1 wherein the processing of the input audio further includes:

a processing task for generating reverberation associated with each of the at least one source image, wherein the reverberation is derived from a reverberation algorithm; and a processing task to filter the input audio for an equalizer.

3. The method of claim 1, further comprising:

receiving an indication of a first audio motion edit, the at least one audio motion edit associated to new spatial attributes; and processing the input audio into output audio having the new spatial attributes that reflect the audio motion edit.

4. The method of claim 3, wherein the first audio motion edit is an image edit, wherein the image edit adjusts the size or transparency of at least one image selected from the group consisting of the listener image and the at least one source image.

5. The method of claim 3, wherein the first audio motion edit is an edit selected from the group consisting of a reverb edit and a space edit.

6. The method of claim 3, wherein the first audio motion edit is an orientation edit, wherein the orientation of at least one image selected from the group consisting of the listener image and the at least one source image is changed.

7. The method of claim 6, wherein the processing of the input audio further includes:

a processing task to add or remove samples from a first buffer; and a processing task to carry over remaining samples from the first buffer to a second buffer if a number of samples added or removed reaches a maximum threshold value.

8. The method of claim 6, further comprising:

receiving an indication of a second audio motion edit, the second audio motion edit is a record edit, wherein the changing of the orientation of the at least one image is recorded and continuously looped until the first audio file is finished playing.

9. The method of claim 6, further comprising:

receiving an indication of a second audio motion edit, the second audio motion edit is a clear edit, wherein the changing of the orientation of the at least one image is reset back to the initial orientation having initial spatial attributes associated with it.

10. The method of claim 3, further comprising:

receiving an indication to save a virtualprogram including the audio motion edit; and saving the virtualprogram, wherein the motion data for the audio motion edit is saved in virtualprogram data files for the virtualprogram, the virtualprogram associated with the first audio file.

11. The method of claim 10, further comprising:

receiving an indication of a visual edit;

generating an edited background image reflecting the visual edit;

receiving an indication to save a virtualprogram including the visual edit; and saving the virtualprogram, wherein visual data for the visual edit is saved in the virtualprogram data files for the virtualprogram.

12. The method of claim 11, wherein the virtualprogram data files include at least one selected from the group consisting of a link for streaming audio and a link for streaming video.

13. The method of claim 11, wherein the virtualprogram data files included at least one lock selected from the group consisting of a video lock, an audio lock, and a motion lock.

14. The method of claim 11, further comprising:

receiving an indication to load and play the virtualprogram;

loading and playing the virtualprogram, the virtualprogram reflecting the saved motion data and the saved visual data;

receiving the input audio for the first audio file for a second time; and processing the input audio file into output audio having spatial attributes associated with the virtualprogram reflecting the saved motion data and the saved visual data.

15. The method of claim 11, wherein the visual edit is an edit selected from the group consisting of a pan edit, rotation edit, and size edit.

16. The method of claim 11, wherein the background image is video that is continuously looped until the first audio file is finished playing.

17. The method of claim 1, wherein the input audio is decoded audio data from one selected from a group consisting of a file in memory, a file on media, a streamed audio file, or a virtual audio cable.

18. The method of claim 1, wherein the background image is imported from one file selected from the group consisting of a file in memory, a file on media, and a streamed video file from an internet server.

19. The method of claim 1, further comprising:

generating a web browser display including a list of audio or video streams that are located on a current webpage in the web browser.

20. The method of claim 19, further comprising;

receiving an indication of selecting a video stream from the list of video streams; and importing the video stream as the background image.

21. The method comprising:

receiving an indication that a first virtualprogram is selected to be loaded and played, the first virtualprogram having an first associated audio file saved within it;

loading and playing the first virtualprogram, wherein the loading and playing of the virtual program includes generating a room display including a background image, a listener image, and at least one source image, wherein the orientation of the listener image and at least one source image have spatial attributes associated with it and are configured according to the first virtualprogram;

receiving input audio for the first associated audio file; and processing the input audio for the first associated audio file into output audio having spatial attributes for the first virtualprogram.

22. The method of claim 21, further comprising:

making the first virtualprogram available for sharing.

23. The method of claim 22, wherein the first virtualprogram includes only links to any audio or video streams and not the actual audio or video file.

24. The method of claim 22, wherein the making the virtualprogram available for sharing includes at least one selected from the following:

i) storing the virtualprogram in local memory; and providing access to have the virtualprogram downloaded from local memory;

ii) storing the virtualprogram on a web server where the virtualprogram is accessible to be downloaded;

iii) transmitting the virtualprogram over the internet; and iv) representing a virtualprogram on a webpage, wherein the representing of the virtualprogram provides access to the virtualprogram.

25. The method of claim 21, further comprising:

generating a library display including a list of audio files of which the first associated audio file is listed; and receiving an indication that the first associated audio file is selected from the library display to be played;

wherein the indication that the virtual program is selected to be loaded and played is in response to the first associated audio file being selected to be played.

26. The method of claim 25, further comprising:

associating the first virtualprogram with a second audio file;

receiving an indication that the second audio file is selected from the library to be played;

loading and playing the first virtualprogram in response to the second audio file being selected to be played;

receiving input audio for the second audio file; and processing the input audio for the second audio file into output audio having spatial attributes for the first virtualprogram.

27. The method of claim 26, wherein the audio files listed in the library display originate from one selected from the group consisting of a file in memory, a file on media, and a streamed audio file from a remote location.

28. The method of claim 25, further comprising:

generating a playlist including a specific list of audio files, wherein at least one of the audio files listed in the playlist is associated with a second virtualprogram, and wherein the audio files listed in the playlist are files selected from the group consisting of a file in memory, a file on media, and a streamed audio file from a remote location.

29. The method of claim 28, further comprising:

making the playlist available for sharing.

30. The method of claim 29, wherein the playlists include only links to any audio or video streams and not the actual audio or video file.

31. The method of claim 29, wherein the making the playlist available for sharing includes at least one of selected from the following:

i) storing the playlist in local memory; and providing access to have the playlist downloaded from local memory;

ii) storing the playlist on a web server where the playlist is accessible to be downloaded;

iii) transmitting the playlist over the internet; and iv) representing a playlist on a webpage, wherein the representing of the playlist provides access to the playlist.

32. The method of claim 28, further comprising:

playing back the playlist, wherein playing back the playlist includes:

receiving input audio for each of the audio files listed in the playlist in an order;

processing the input audio for each of the audio files listed in the specific list of audio files into output audio, wherein the output audio for the at least one audio file listed in the playlist that is associated with the second virtualprogram has spatial attributes for the virtual program.

33. A non-transitory machine-readable medium that provides instructions, which when executed by a machine, cause the machine to perform operations comprising:

generating a room display including a background image, a listener image, and at least one source image, wherein the listener image and at least one source image are displayed in an initial orientation, the initial orientation having initial spatial attributes associated with it;

receiving an indication of a first audio file to be played with the initial spatial attributes;

receiving input audio for the first audio file; and processing the input audio into output audio having the initial spatial attributes;

wherein processing of the input audio includes a processing task for sampling the orientations of the listener image and the at least one source image, the sampling used to determine a source azimuth and first order reflections for each of the at least one source image within the room display.

34. The non-transitory machine-readable medium of claim 33 that provides instructions, which when executed by a machine, cause the machine to perform operations further comprising:

receiving an indication of a first audio motion edit, the at least one audio motion edit associated to new spatial attributes; and processing the input audio into output audio having the new spatial attributes that reflect the audio motion edit.

35. The non-transitory machine-readable medium of claim 34 that provides instructions, which when executed by a machine, cause the machine to perform operations further comprising:

receiving an indication of a second audio motion edit, the second audio motion edit is a record edit;

wherein the first audio motion edit is an orientation edit, wherein the orientation of at least one image selected from the group consisting of the listener image and the at least one source image is changed; and wherein the changing of the orientation of the at least one image is recorded and continuously looped until the first audio file is finished playing.

36. The non-transitory machine-readable medium of claim 34 that provides instructions, which when executed by a machine, cause the machine to perform operations further comprising:

receiving an indication to save a virtualprogram including the audio motion edit;

saving the virtualprogram, wherein the motion data for the audio motion edit is saved in virtualprogram data files for the virtualprogram, the virtualprogram associated with the first audio file;

receiving an indication of a visual edit;

generating an edited background image reflecting the visual edit;

receiving an indication to save a virtualprogram including the visual edit; and saving the virtualprogram, wherein visual data for the visual edit is saved in the virtualprogram data files for the virtualprogram.

37. The non-transitory machine-readable medium of claim 36, wherein the virtualprogram data files include at least one selected from the group consisting of a link for streaming audio and a link for streaming video.

38. The non-transitory machine-readable medium of claim 33 that provides instructions, which when executed by a machine, cause the machine to perform operations further comprising:

generating a web browser display including a list of audio and video streams that are located on a current webpage in the web browser;

receiving an indication of selecting a video stream from the list of video streams; and importing the video stream as the background image.

39. A non-transitory machine-readable medium that provides instructions, which when executed by a machine, cause the machine to perform operations comprising:

receiving an indication that a first virtualprogram is selected to be loaded and played, the first virtualprogram having an first associated audio file saved within it;

loading and playing the first virtualprogram, wherein the loading and playing of the virtual program includes generating a room display including a background image, a listener image, and at least one source image, wherein the orientation of the listener image and at least one source image have spatial attributes associated with it and are configured according to the first virtualprogram;

receiving input audio for the first associated audio file; and processing the input audio for the first associated audio file into output audio having spatial attributes for the first virtualprogram.

40. The non-transitory machine-readable medium of claim 39 that provides instructions, which when executed by a machine, cause the machine to perform operations further comprising:

making the first virtualprogram available for sharing;

wherein the making the virtualprogram available for sharing includes at least one selected from the following:

i) storing the virtualprogram in local memory; and providing access to have the virtualprogram downloaded from local memory;

ii) storing the virtualprogram on a web server where the virtualprogram is accessible to be downloaded;

iii) transmitting the virtualprogram over the internet; and iv) representing a virtualprogram on a webpage, wherein the representing of the virtualprogram provides access to the virtualprogram.

41. The non-transitory machine-readable medium of claim 40, wherein the first virtualprogram includes only links to any audio or video streams and not the actual audio or video file.

42. The non-transitory machine-readable medium of claim 39 that provides instructions, which when executed by a machine, cause the machine to perform operations further comprising:

generating a library display including a list of audio files of which the first associated audio file is listed; and receiving an indication that the first associated audio file is selected from the library display to be played;

wherein the indication that the virtual program is selected to be loaded and played is in response to the first associated audio file being selected to be played.

43. The non-transitory machine-readable medium of claim 42 that provides instructions, which when executed by a machine, cause the machine to perform operations further comprising:

associating the first virtualprogram with a second audio file;

receiving an indication that the second audio file is selected from the library to be played;

loading and playing the first virtualprogram in response to the second audio file being selected to be played;

receiving input audio for the second audio file; and processing the input audio for the second audio file into output audio having spatial attributes for the first virtualprogram.

44. The non-transitory machine-readable medium of claim 42 that provides instructions, which when executed by a machine, cause the machine to perform operations further comprising:

generating a playlist including a specific list of audio files, wherein at least one of the audio files listed in the playlist is associated with a second virtualprogram, and wherein the audio files listed in the playlist are files selected from the group consisting of a file in memory, a file on media, and a streamed audio file from a remote location.

45. The non-transitory machine-readable medium of claim 44 that provides instructions, which when executed by a machine, cause the machine to perform operations further comprising:

making the playlist available for sharing;

wherein the making the playlist available for sharing includes at least one of selected from the following:

i) storing the playlist in local memory; and providing access to have the playlist downloaded from local memory;

ii) storing the playlist on a web server where the playlist is accessible to be downloaded;

iii) transmitting the playlist over the internet; and iv) representing a playlist on a webpage, wherein the representing of the playlist provides access to the playlist.

46. The non-transitory machine-readable medium of claim 45, wherein the playlist includes only links to any audio or video streams and not the actual audio or video file.

* * * * *